US011694624B2

(12) United States Patent
Wang et al.

(10) Patent No.: US 11,694,624 B2
(45) Date of Patent: Jul. 4, 2023

(54) PIXEL COMPENSATION DEVICE, PIXEL COMPENSATION METHOD AND DISPLAY APPARATUS

(71) Applicant: BOE TECHNOLOGY GROUP CO., LTD., Beijing (CN)

(72) Inventors: Tangxiang Wang, Beijing (CN); Fei Yang, Beijing (CN); Yu Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/790,085

(22) PCT Filed: Jun. 2, 2021

(86) PCT No.: PCT/CN2021/097978

§ 371 (c)(1),
(2) Date: Jun. 29, 2022

(87) PCT Pub. No.: WO2021/249264

PCT Pub. Date: Dec. 16, 2021

(65) Prior Publication Data

US 2023/0042060 A1 Feb. 9, 2023

(30) Foreign Application Priority Data

Jun. 11, 2020 (CN) ..... 202010527799.5

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 3/3258; G09G 3/3233; G09G 2300/0842; G09G 2300/0819;
(Continued)

(56) References Cited

U.S. PATENT DOCUMENTS 9,460,661 B2 * 10/2016 Shim ..... G09G 3/3233
9,685,119 B2 * 6/2017 Kim ..... G09G 3/006
(Continued)

FOREIGN PATENT DOCUMENTS

CN 103050083 A 4/2013
CN 103117040 A 5/2013
(Continued)

OTHER PUBLICATIONS

First Office Action for the Chinese Patent Application No. 202010527799.5 issued by the Chinese Patent Office dated Jan. 6, 2021.

*Primary Examiner* — Tom V Sheng
(74) *Attorney, Agent, or Firm* — IP & T Group LLP

(57) ABSTRACT

A pixel compensation device includes a controller and at least one external compensation circuit. In the external compensation circuit, a first input circuit is configured to transmit a first voltage to a first terminal of a driving sub-circuit in a initialization phase, perform blanking in a pre-storage phase, and transmit a threshold compensation voltage to the first terminal in the data compensation writing phase; a second input circuit is configured to transmit a second voltage to a control terminal of the driving sub-circuit in the initialization phase and the pre-storage phase, so that a voltage of the first terminal changes from the first voltage to the threshold compensation voltage in the pre-storage phase; a sensing circuit is configured to sense the threshold compensation voltage in the data compensation writing phase; and the controller is configured to transmit a
(Continued)

data voltage to the control terminal in the data compensation writing phase.

20 Claims, 21 Drawing Sheets

(52) U.S. Cl.
CPC ..... *G09G 2300/0842* (2013.01); *G09G 2310/061* (2013.01); *G09G 2320/0233* (2013.01); *G09G 2320/043* (2013.01); *G09G 2320/045* (2013.01)

(58) Field of Classification Search
CPC ..... G09G 2310/061; G09G 2320/0233; G09G 2320/043; G09G 2320/045
USPC ..... 345/204
See application file for complete search history.

(56) References Cited

U.S. PATENT DOCUMENTS

| | | | | |
|---|---|---|---|---|
| 10,347,181 | B2 * | 7/2019 | Zhu | G09G 3/3233 |
| 10,510,293 | B2 * | 12/2019 | Jung | G09G 3/3233 |
| 2006/0061560 | A1 * | 3/2006 | Yamashita | G09G 3/3233 345/204 |
| 2013/0093652 | A1 | 4/2013 | Kim et al. | |
| 2015/0103037 | A1 | 4/2015 | Wu et al. | |
| 2015/0279277 | A1 * | 10/2015 | Xu | G09G 3/3233 345/77 |
| 2016/0171930 | A1 * | 6/2016 | Song | G09G 3/3225 345/77 |
| 2017/0162125 | A1 * | 6/2017 | Liang | G09G 3/3233 |
| 2017/0263180 | A1 | 9/2017 | Zhu | |
| 2017/0278457 | A1 * | 9/2017 | Zhu | G09G 3/3233 |
| 2019/0139470 | A1 | 5/2019 | Yoo et al. | |
| 2019/0156747 | A1 * | 5/2019 | Nie | G09G 3/3233 |
| 2019/0237019 | A1 * | 8/2019 | Gao | G09G 3/3233 |
| 2020/0043414 | A1 * | 2/2020 | Wang | G09G 3/3233 |
| 2021/0027712 | A1 * | 1/2021 | Kim | G09G 3/3291 |
| 2021/0142735 | A1 * | 5/2021 | Cho | G09G 3/3233 |
| 2021/0183303 | A1 * | 6/2021 | Kim | G09G 3/32 |
| 2021/0272519 | A1 * | 9/2021 | Cao | G09G 3/3233 |
| 2021/0407403 | A1 * | 12/2021 | Yin | G09G 3/3618 |
| 2022/0108655 | A1 * | 4/2022 | Yu | G09G 3/3233 |

FOREIGN PATENT DOCUMENTS

| | | | |
|---|---|---|---|
| CN | 103295525 | A | 9/2013 |
| CN | 104200779 | A | 12/2014 |
| CN | 105047137 | A | 11/2015 |
| CN | 105096838 | A | 11/2015 |
| CN | 106328061 | A | 1/2017 |
| CN | 106504707 | A | 3/2017 |
| CN | 108109588 | A | 6/2018 |
| CN | 108766349 | A | 11/2018 |
| CN | 111583872 | A | 8/2020 |

* cited by examiner

PIXEL COMPENSATION DEVICE, PIXEL COMPENSATION METHOD AND DISPLAY APPARATUS

CROSS-REFERENCE TO RELATED APPLICATIONS

This application is a national phase entry under 35 USC 371 of International Patent Application No. PCT/CN2021/097978 filed on Jun. 2, 2021, which claims priority to Chinese Patent Application No. 202010527799.5, filed on Jun. 11, 2020, which are incorporated herein by reference in their entirety.

TECHNICAL FIELD

The present disclosure relates to the field of display, for example, to a pixel compensation device, a pixel compensation method, and a display apparatus.

BACKGROUND

The active-matrix organic light-emitting diode (AMOLED) display technology has been widely used in the industry due to its advantages such as ultra lightness and thinness, high color gamut, high contrast, wide viewing angle, and fast response speed.

SUMMARY

In one aspect, a pixel compensation device is provided. The pixel compensation device includes a controller and at least one external compensation circuit connected to the controller. An external compensation circuit is configured to be connected to at least one pixel driving circuit. The pixel driving circuit includes a driving sub-circuit, and a first terminal of the driving sub-circuit is configured to be connected to a light-emitting device; and a light-emitting driving period of the pixel driving circuit includes an initialization phase, a pre-storage phase and a data compensation writing phase. The external compensation circuit includes a first input circuit, a second input circuit and a sensing circuit. The first input circuit is connected to the sensing circuit. The first input circuit is configured to be further connected to the first terminal of the driving sub-circuit, and the first input circuit is further configured to: transmit a first voltage to the first terminal of the driving sub-circuit in the initialization phase; perform blanking in the pre-storage phase; and transmit a threshold compensation voltage to the first terminal of the driving sub-circuit in the data compensation writing phase. The second input circuit is configured to be connected to a control terminal of the driving sub-circuit. The second input circuit is further configured to transmit a second voltage to the control terminal of the driving sub-circuit in the initialization phase and the pre-storage phase, so that a voltage of the first terminal of the driving sub-circuit changes from the first voltage to the threshold compensation voltage in the pre-storage phase. The first voltage and the threshold compensation voltage are both less than a turn-on voltage of the light-emitting device, and a threshold compensation voltage is equal to a difference between the second voltage and the threshold voltage of the driving sub-circuit. The sensing circuit is configured to be further connected to the first terminal of the driving sub-circuit, and the sensing circuit is further configured to: sense the threshold compensation voltage in the data compensation writing phase; and transmit the threshold compensation voltage to the first input circuit. The controller is configured to be further connected to the control terminal of the driving sub-circuit, and the controller is further configured to transmit a data voltage to the control terminal of the driving sub-circuit in the data compensation writing phase.

In some embodiments, the sensing circuit is further connected to the controller, and the sensing circuit is further configured to: sense a first current transmitted by the first terminal of the driving sub-circuit and transmit the first current to the controller in the initialization phase; and transmit the sensed threshold compensation voltage to the controller in the data compensation writing phase. The controller is further configured to: determine the actual characteristic value of the driving sub-circuit according to the first current and the threshold compensation voltage; and correct a data voltage to be transmitted in a next data compensation writing phase according to the actual characteristic value.

In some embodiments, the light-emitting driving period further includes an aging sensing phase. The second input circuit is further configured to transmit a third voltage to the control terminal of the driving sub-circuit in the aging sensing phase, so as to control the driving sub-circuit to be turned off. The sensing circuit is further configured to sense a second current transmitted from the light-emitting device to the first terminal of the driving sub-circuit in the aging sensing phase, and transmit the second current to the controller. The controller is further configured to determine aging information of the light-emitting device according to the second current; and correct the data voltage to be transmitted in the next data compensation writing phase according to the aging information.

In some embodiments, the sensing circuit includes a voltage sensing sub-circuit, and the voltage sensing sub-circuit is connected to the first terminal of the driving sub-circuit and the first input circuit. The voltage sensing sub-circuit is configured to, in the data compensation writing phase, sense the threshold compensation voltage at the first terminal of the driving sub-circuit and transmit the threshold compensation voltage to the first input circuit.

In some embodiments, the voltage sensing sub-circuit is further connected to the controller. The voltage sensing sub-circuit is further configured to transmit the sensed threshold compensation voltage to the controller in the data compensation writing phase.

In some embodiments, the light-emitting driving period further includes a first calibration phase. The first input circuit is further configured to transmit the first voltage to the voltage sensing sub-circuit in the first calibration phase, so that the voltage sensing sub-circuit outputs a fourth voltage to the controller. The controller is further configured to correct a sensing voltage signal transmitted from the voltage sensing sub-circuit to the controller according to a difference between the fourth voltage and the first voltage. The sensing voltage signal includes the threshold compensation voltage.

In some embodiments, the voltage sensing sub-circuit includes a first operational amplifier, a fourth switch and a fifth switch. A non-inverting input terminal of the first operational amplifier is connected to the first terminal of the driving sub-circuit through the fourth switch. An inverting input terminal of the first operational amplifier is connected to an output terminal of the first operational amplifier through the fifth switch.

In some embodiments, the sensing circuit includes a current sensing sub-circuit, and the current sensing sub-circuit is connected to the first terminal of the driving sub-circuit and the controller. The current sensing sub-circuit is configured to: sense the first current at the first terminal of the driving sub-circuit and transmit the first current to the controller in the initialization phase; and/or sense the second current at the first terminal of the driving sub-circuit and transmit the second current to the controller in the aging sensing phase.

In some embodiments, the light-emitting driving period further includes a second calibration phase. The current sensing sub-circuit is further connected to a reference current source. The reference current source is configured to transmit a reference current to the current sensing sub-circuit in the second calibration phase, so that the current sensing sub-circuit outputs a third current. The controller is further configured to correct at least one sensing current signal transmitted by the current sensing sub-circuit to the controller according to a difference between the third current and the reference current. The at least one sensing current signal includes the first current and/or the second current.

In some embodiments, the current sensing sub-circuit includes the first operational amplifier, an integrating capacitor, a first switch and a second switch. The non-inverting input terminal of the first operational amplifier is connected to a reference voltage terminal through the second switch. The inverting input terminal of the first operational amplifier is connected to the first terminal of the driving sub-circuit through the first switch. The inverting input terminal of the first operational amplifier is further connected to a first electrode of the integrating capacitor. The output terminal of the first operational amplifier is connected to a second electrode of the integrating capacitor and the controller.

In some embodiments, the second input circuit includes a multiplexer. The multiplexer includes a first input terminal, a second input terminal and an output terminal. The first input terminal is connected to a second voltage terminal, and is configured to receive the second voltage transmitted by the second voltage terminal. The second input terminal is connected to the controller, and is configured to receive the data voltage transmitted by the controller. The output terminal of the multiplexer is connected to the control terminal of the driving sub-circuit, and is configured to: transmit the second voltage to the control terminal of the driving sub-circuit in the initialization phase and the pre-storage phase; and transmit the data voltage to the control terminal of the driving sub-circuit in the data compensation writing phase.

In some embodiments, in a case where the light-emitting driving period further includes the aging sensing phase, the multiplexer further includes a third input terminal. The third input terminal is connected to a third voltage terminal, and is configured to receive the third voltage transmitted by the third voltage terminal. The output terminal of the multiplexer is further configured to transmit the third voltage to the control terminal of the driving sub-circuit in the aging sensing phase.

In some embodiments, the second input circuit further includes a third operational amplifier. A non-inverting input terminal of the third operational amplifier is connected to the output terminal of the multiplexer. An output terminal of the third operational amplifier is connected to the control terminal of the driving sub-circuit. An inverting input terminal of the third operational amplifier is connected to the output terminal of the third operational amplifier.

In some embodiments, the first input circuit includes a second operational amplifier, a sixth switch and a seventh switch. A non-inverting input terminal of the second operational amplifier is connected to the sensing circuit through the sixth switch, and is further connected to a first voltage terminal through the seventh switch. An inverting input terminal of the second operational amplifier is connected to an output terminal of the second operational amplifier. The output terminal of the second operational amplifier is further connected to the first terminal of the driving sub-circuit.

In some embodiments, the external compensation circuit further includes a storage circuit, and the storage circuit is connected between the sensing circuit and the controller. The storage circuit is configured to store the at least one sensing signal output by the sensing circuit, and transmit the at least one sensing signal to the controller in response to an output control signal. The at least one sensing signal includes at least the threshold compensation voltage.

In some embodiments, the storage circuit includes a storage capacitor, an eighth switch and a ninth switch. The sensing circuit is connected to a first electrode of the storage capacitor through the eighth switch. The controller is connected to the first electrode of the storage capacitor through the ninth switch. A second electrode of the storage capacitor is grounded.

In some embodiments, the driving sub-circuit includes a driving transistor. A first electrode of the driving transistor is the first terminal of the driving sub-circuit. A control electrode of the driving transistor is the control terminal of the driving sub-circuit.

In another aspect, a pixel compensation method is provided. The pixel compensation method is applied to the pixel compensation device according to any one of above embodiments. The pixel compensation method includes a plurality of light-emitting driving periods, and a light-emitting driving period of the plurality of light-emitting driving periods includes the initialization phase, the pre-storage phase and the data compensation writing phase. In the initialization phase, the first input circuit transmits the first voltage to the first terminal of the driving sub-circuit, and the second input circuit transmits the second voltage to the control terminal of the driving sub-circuit, so that the driving sub-circuit is turned on. In the pre-storage phase, the first input circuit performs to blanking, and the second input circuit maintains a voltage of the control terminal of the driving sub-circuit at the second voltage, so that a voltage of the first terminal of the driving sub-circuit changes from the first voltage to the threshold compensation voltage. In the data compensation writing phase, the controller transmits the data voltage to the control terminal of the driving sub-circuit, the sensing circuit senses the threshold compensation voltage and transmits the threshold compensation voltage to the first input circuit, and the first input circuit feeds the threshold compensation voltage back to the first terminal of the driving sub-circuit.

In some embodiments, the data voltage is the voltage corrected by the controller according to an actual characteristic value of the driving sub-circuit determined in a previous light-emitting driving period.

In some embodiments, in the initialization phase, the driving sub-circuit is turned on to output a first current, and the sensing circuit senses the first current and transmits the first current to the controller. In the data compensation writing phase, the sensing circuit transmits the sensed threshold compensation voltage to the controller, the controller determines the actual characteristic value of the driving sub-circuit according to the first current and the threshold compensation voltage and corrects a data voltage to be transmitted in a next data compensation writing phase according to the actual characteristic value.

In some embodiments, the light-emitting driving period further includes an aging sensing phase. The pixel compensation method further includes: in the aging sensing phase, the second input circuit transmitting a third voltage to the control terminal of the driving sub-circuit to control the driving sub-circuit to be turned off; the sensing circuit sensing a second current transmitted from the light-emitting device to the first terminal of the driving sub-circuit; and the controller determining aging information of the light-emitting device according to the second current and correcting a data voltage to be transmitted according to the aging information.

In some embodiments, the controller is connected to a plurality of external compensation circuits, and the external compensation circuit is connected to pixel driving circuits. Different sensing circuits in different external compensation circuits or a same external compensation circuit sense the first current for a same duration; and/or, different sensing circuits in different external compensation circuits or a same external compensation circuit sense the second current for a same duration.

In some embodiments, the sensing circuit includes a voltage sensing sub-circuit. The light-emitting driving period further includes a first calibration phase. The pixel compensation method further include: in the first calibration phase, the first input circuit transmitting the first voltage to the voltage sensing sub-circuit, so that the voltage sensing sub-circuit outputs a fourth voltage to the controller; and in the first calibration phase, the controller correcting a sensing voltage signal transmitted from the voltage sensing sub-circuit to the controller according to a difference between the fourth voltage and the first voltage.

In some embodiments, the sensing circuit includes a current sensing sub-circuit. The light-emitting driving period further includes a second calibration phase. The pixel compensation method further includes: in the second calibration phase, a reference current source transmitting a reference current to the current sensing sub-circuit, so that the current sensing sub-circuit outputs a third current; and in the second calibration phase, the controller correcting at least one sensing current signal transmitted by the current sensing sub-circuit to the controller according to a difference between the third current and the reference current In yet another aspect, a display apparatus is provided. The display apparatus includes the pixel compensation device according to any of the embodiments described above.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described below are merely accompanying drawings of some embodiments of the present disclosure, and a person of ordinary skill in the art can obtain other drawings according to these drawings. In addition, the accompanying drawings in the following description may be regarded as schematic diagrams, and are not limitations on actual sizes of products, actual processes of methods and actual timings of signals involved in the embodiments of the present disclosure.

DETAILED DESCRIPTION

Figure 1:
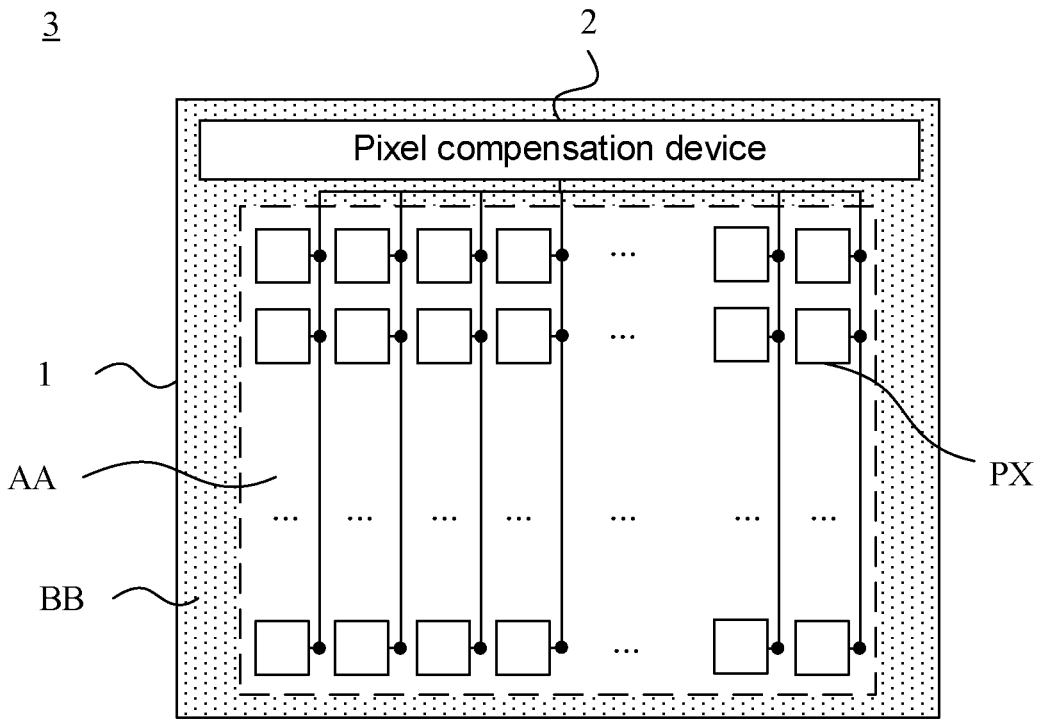
FIG. 1 is a structural diagram of a display apparatus, in accordance with some embodiments of the present disclosure.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to". In the description of the specification, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or examples(s). In addition, the specific features, structures, materials or characteristics may be included in any one or more embodiments or examples in any suitable manner.

Hereinafter, the terms such as "first" and "second" are only used for descriptive purposes, and are not to be construed as indicating or implying relative importance or implicitly indicating the number of indicated technical features. Thus, a feature defined with "first" or "second" may explicitly or implicitly include one or more of the features. In the description of the embodiments of the present disclosure, the term "a plurality of/the plurality of" means two or more unless otherwise specified.

In the description of some embodiments, the term "connected" and derivatives thereof may be used. For example, the term "connected" may be used in the description of some embodiments to indicate that two or more components are in direct physical or electrical contact with each other. The embodiments disclosed herein are not necessarily limited to the contents herein.

The phrase "at least one of A, B and C" has the same meaning as the phrase "at least one of A, B or C", and they both include the following combinations of A, B and C: only A, only B, only C, a combination of A and B, a combination of A and C, a combination to of B and C, and a combination of A, B and C.

The phrase "A and/or B" includes the following three combinations: only A, only B, and a combination of A and B.

The phrase "applicable to" or "configured to" as used herein indicates an open and inclusive expression, which does not exclude devices that are applicable to or configured to perform additional tasks or steps.

Additionally, the use of the phrase "based on" is meant to be open and inclusive, since a process, step, calculation or other action that is "based on" one or more of the stated conditions or values may, in practice, be based on additional conditions or values beyond those stated.

The term "equal" as used herein includes a stated condition and a condition similar to the stated condition. The similar condition is within an acceptable range of deviation, and the acceptable range of deviation is determined by a person of ordinary skill in the art in view of a measurement in question and an error associated with a measurement of a particular quantity (i.e., limitations of a measurement system). For example, the term "equal" includes absolute equality and approximate equality. The acceptable range of deviation of the approximate equality may be that, for example, a difference value between the two that are equal is less than or equal to 5% of either of the two.

A sub-pixel in an AMOLED display substrate includes a light-emitting device (i.e., an organic light-emitting diode (OLED)) and a pixel circuit connected to the OLED. An output current of a driving transistor (e.g., a driving thin film transistor (DTFT)) in the pixel circuit is used to drive a corresponding OLED to emit light, which directly determines luminance of the OLED. The output current $I_{ds}$ of the driving transistor satisfies the following formula:

$$I_{ds} = \frac{1}{2}\mu C_{ox}\frac{W}{L}(V_{gs} - V_{th})^2;$$

$$K = \frac{1}{2}\mu C_{ox}\frac{W}{L}.$$

$\mu$ is an electron mobility of the driving transistor, $C_{ox}$ is a capacitance per unit area of a gate oxide layer of the driving transistor, $$\frac{W}{L}$$

is a channel width-to-length ratio of the driving transistor, $V_{gs}$ is a gate-source voltage difference of the driving transistor, $V_{th}$ is a threshold voltage of the driving transistor, and K is referred to a characteristic value of the driving transistor. K is related to the electron mobility of the driving transistor.

The threshold voltages or the electron mobilities of the driving transistors in the pixel circuits may be different due to process difference. In addition, as service time increases, parameters such as the threshold voltage and the electron mobility of each driving transistor tend to drift. Therefore, driving capabilities (i.e., capabilities of outputting currents under the same light-emitting driving voltage) of the driving transistors will be different, resulting in a problem of uneven display of the AMOLED display substrate.

In the related art, an AMOLED display apparatus may compensate a sub-pixel in two ways, i.e., an internal compensation and an external compensation, so as to solve the problem of uneven display of the AMOLED display substrate. The internal compensation refers to providing a compensation sub-circuit in the sub-pixel to compensate the sub-pixel. This compensation way tends to reduce an aperture ratio of the pixel and a driving speed of the AMOLED display substrate. The external compensation refers to sensing a relevant electrical signal (e.g., a voltage or a current) of the sub-pixel by a circuit or device outside the sub-pixel, and adjusting a relevant input signal (e.g., a data voltage) of the corresponding sub-pixel according to the electrical signal, so as to achieve the compensation of the sub-pixel. This compensation way has advantages of fast driving speed and good compensation effect.

Based on this, referring to FIG. 1, some embodiments of the present disclosure provide a display apparatus 3. The display apparatus 3 generally includes a display substrate 1 and a pixel compensation device 2.

It will be noted that the type of the display apparatus 3 may vary. For example, the display apparatus 3 may be an OLED display apparatus (e.g., an AMOLED display apparatus), a quantum dot light-emitting diode (QLED) display apparatus, or a light-emitting diode (LED) display apparatus. There may be a variety of products of the display apparatus 3. For example, the display apparatus 3 may be any product or component having a display function, such as an electronic paper, a television, a display, a notebook computer, a tablet computer, a digital photo frame, a mobile phone, a navigator, etc.

The display substrate 1 has a display area AA and a non-display area BB located on at least one side of the display area AA. A plurality of sub-pixels PX are provided in the display area AA, and the plurality of sub-pixels PX may include, for example, a plurality of red sub-pixels, a plurality of green sub-pixels, and a plurality of blue sub-pixels. For example, the plurality of sub-pixels PX are distributed in the display area AA in an array, and every three sub-pixels PX may constitute one pixel. Each sub-pixel PX includes a light-emitting device and a pixel driving circuit 101 connected to the light-emitting device. The pixel driving circuit 101 is configured to drive a corresponding light-emitting device to emit light.

It will be noted that the type of the display substrate 1 may vary. For example, the display substrate 1 may be an OLED display substrate (e.g., an AMOLED display substrate), a QLED display substrate or an LED display substrate.

The type of the light-emitting device may vary, and the type of the light-emitting device matches the type of the display substrate 1 corresponding to the light-emitting device. For example, the light-emitting device corresponding to the OLED display substrate is an OLED. For another example, the light-emitting device corresponding to the QLED display substrate is a QLED. For yet another example, the light-emitting device corresponding to the LED display substrate is a LED.

The function of the pixel driving circuit 101 is as described above, and its structure is, but is not limited to, "2T1C", "3T1C", "6T1C", "6T2C", "7T1C", "7T2C" or "8T1C". "T" represents transistor, the number before the "T" represents the number of transistors, "C" represents capacitor, and the number before the "C" represents the number of capacitors. For example, "3T1C" represents three transistors and one capacitor.

Figure 3:
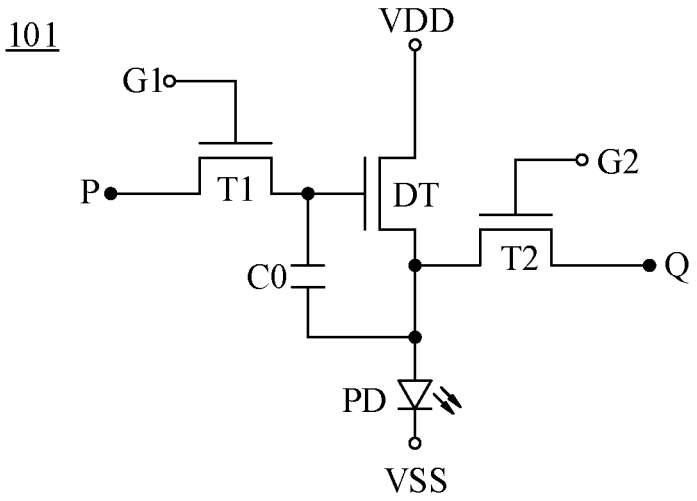
FIG. 3 is a structural diagram of a pixel driving circuit, in accordance with some embodiments of the present disclosure.

For example, the structure of "3T1C" is as shown in FIG. 3. The pixel driving circuit 101 with the structure of "3T1C" includes a first transistor T1, a second transistor T2, a driving transistor DT and a first capacitor C0. A control electrode of the first transistor T1 is connected to a first scanning signal line G1, a first electrode of the first transistor T1 is connected to a control electrode of the driving transistor DT and a first electrode of the first capacitor C0, and a second electrode of the first transistor T1 is connected to a node P. A first electrode of the driving transistor DT is connected to a second electrode of the first capacitor C0, a first electrode of the light-emitting device PD and a first electrode of the second transistor T2, and a second electrode of the driving transistor DT is connected to a first power voltage terminal VDD. A control electrode of the second transistor T2 is connected to a second scanning signal line G2, and a second electrode of the second transistor T2 is connected to a node Q. A second electrode of the light-emitting device PD is connected to a second power voltage terminal VSS. The node P is a node where a component for providing a voltage to the control electrode of the driving transistor DT is connected to the pixel driving circuit 101. The node Q may be a node where a component for sensing a relevant signal (a current or a voltage) of the driving transistor DT or the light-emitting device PD is connected to the pixel driving circuit 101, and/or a node where a component for providing a voltage to the first electrode of the driving transistor DT is connected to the pixel driving circuit 101.

It will be noted that, in the circuit provided in the embodiments of the present disclosure, the node P and the node Q do not represent components that actually exist, but represent junction points of relevant electrical connections in a circuit diagram. That is, these nodes are nodes equivalent to the junction points of the relevant electrical connections in the circuit diagram.

For example, the light-emitting device PD is the OLED. The first electrode of the light-emitting device PD is an anode of the OLED, and the second electrode of the light-emitting device PD is a cathode of the OLED. Based on this, it can be easily understood that, the first power voltage terminal VDD provides a high voltage, and the second power voltage terminal VSS provides a low voltage. For example, the second power voltage terminal VSS is grounded.

It will be noted that, each transistor involved in the embodiments of the present disclosure may be an N-type thin film transistor, a P-type thin film transistor or any other device with the same characteristic.

The embodiments of the present disclosure are described by taking the N-type thin film transistor as an example.

In some examples, the control electrode of each transistor in the pixel driving circuit 101 is a gate of the transistor, the first electrode of the transistor is one of a source and a drain of the transistor, and the second electrode of the transistor is the other of the source and the drain of the transistor. It will be noted that, since the source and the drain of the transistor may be symmetrical in structure, the source and the drain thereof may be indistinguishable in structure. That is, the first electrode and the second electrode of the transistor may be indistinguishable in structure. For example, in a case where each to transistor is the N-type thin film transistor, the control electrode of the thin film transistor is the gate, the first electrode of the thin film transistor is the source, and the second electrode of the thin film transistor is the drain.

The pixel compensation device 2 is connected to each sub-pixel PX of the display substrate 1.

Figure 2:
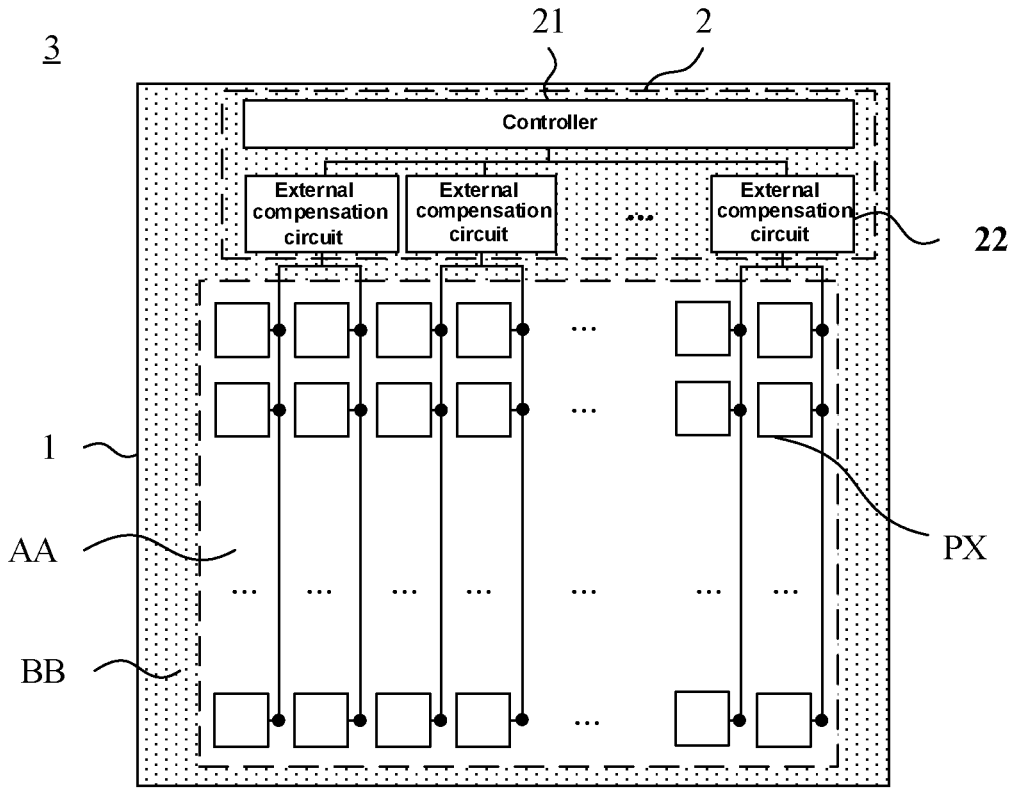
FIG. 2 is a structural diagram of another display apparatus, in accordance with some embodiments of the present disclosure.

Referring to FIG. 2, the pixel compensation device 2 provided in some embodiments of the present disclosure includes a controller 21 and external compensation circuit(s) 22 connected to the controller 21. For example, the external compensation circuit 22 may be arranged independently, or may be integrated in the non-display area BB of the display substrate 1.

It will be noted that, the controller 21 is an electronic device having functions of signal transmission, data storage and processing. For example, the controller 21 may be a timing controller (TCON). There may be one or more external compensation circuits 22 connected to the controller 21, which is determined according to actual needs, and is not limited in the embodiments of the present disclosure. For example, as shown in FIG. 2, the number of external compensation circuits 22 connected to the controller 21 is multiple.

In some examples, the external compensation circuit 22 is located outside the sub-pixels PX (i.e., located in the non-display area BB), and is connected to the pixel driving circuit 101 of at least one sub-pixel PX.

It will be noted that, the number of pixel driving circuits 101 connected to a single external compensation circuit 22 may be one or more, which may be determined according to actual needs.

In some examples, the number of pixel driving circuits 101 connected to the single external compensation circuit 22 is multiple. In this case, a corresponding relationship of each external compensation circuit 22 and pixel driving circuits 101 of the display substrate 1 may be determined according to actual needs, as long as their respective functions are able to be successfully realized. For example, as shown in FIG. 2, the plurality of sub-pixels PX of the display substrate 1 are driven to perform display in a row-by-row manner, a single external compensation circuit 22 is connected to pixel driving circuits 101 in a plurality of columns (e.g., two columns) of sub-pixels PX, and pixel driving circuits 101 corresponding to any two external compensation circuits 22 are different. With this design, the multiple external compensation circuits 22 may simultaneously sense and compensate sub-pixels PX in different columns of the same row, and the pixel compensation device 2 may achieve the compensation of all sub-pixels PX of the display substrate 1 by arranging a small number of external compensation circuits 22, which effectively improves the compensation efficiency.

Figure 4:
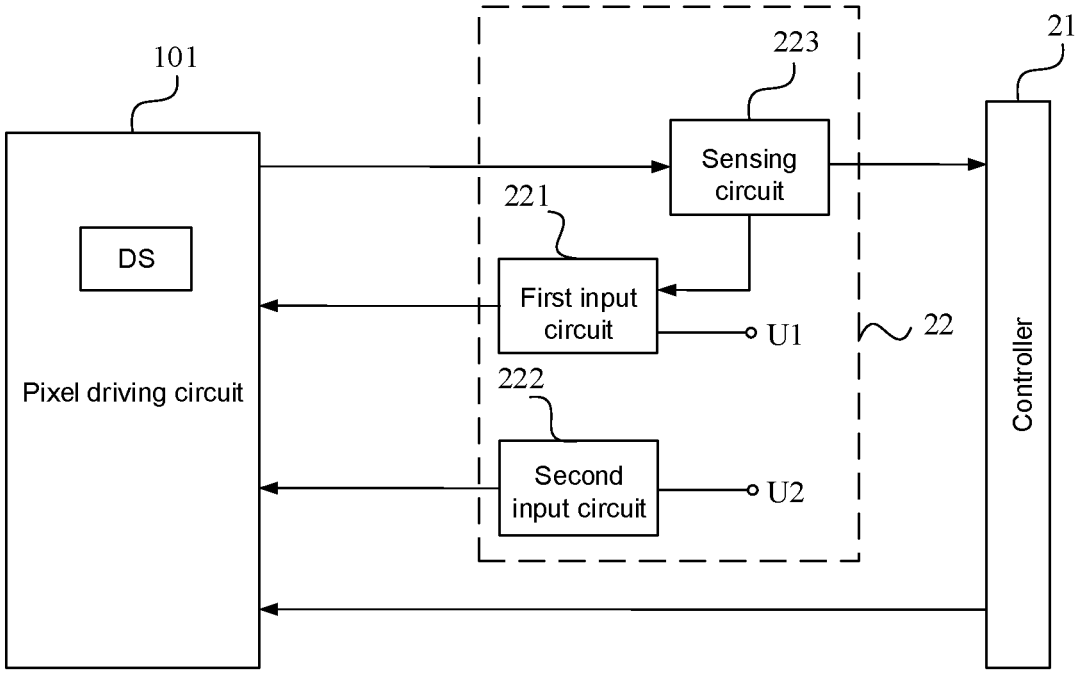
FIG. 4 is a structural diagram of a pixel compensation device, in accordance with some embodiments of the present disclosure.
Figure 5:
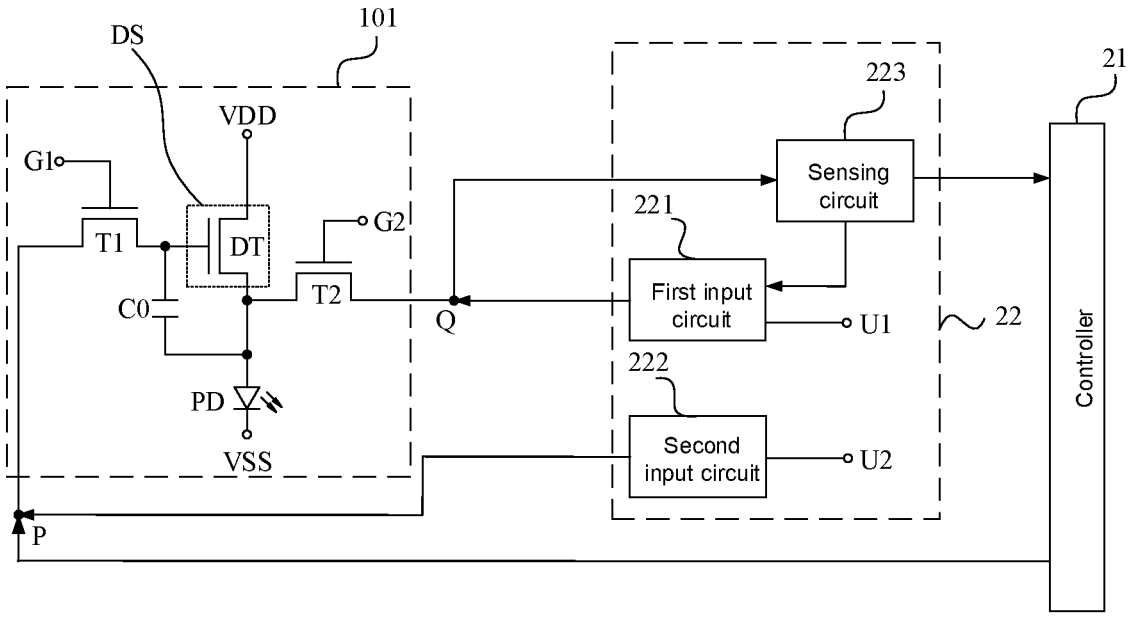
FIG. 5 is a structural diagram of another pixel compensation device, in accordance with some embodiments of the present disclosure.
Figure 6:
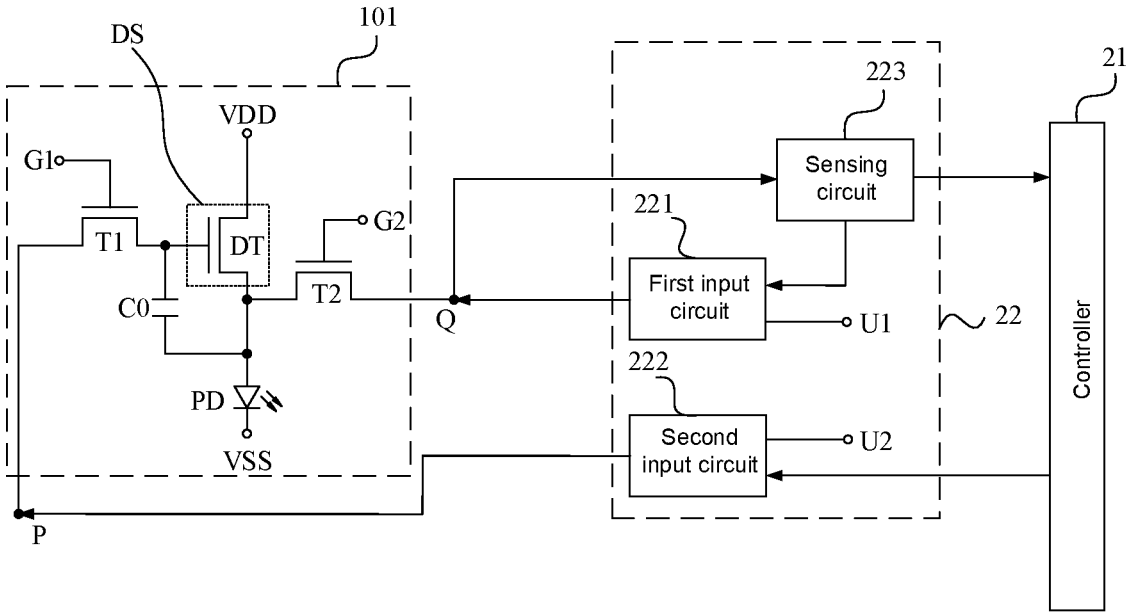
FIG. 6 is a structural diagram of yet another pixel compensation device, in accordance with some embodiments of the present disclosure.

In some examples, referring to FIGS. 4 to 6, the pixel driving circuit 101 includes a driving sub-circuit DS. A first terminal of the driving sub-circuit DS is connected to the light-emitting device PD. A light-emitting driving period of the pixel driving circuit includes an initialization phase, a pre-storage phase and a data compensation writing phase.

Referring to FIGS. 4 to 6, the external compensation circuit 22 includes a first input circuit 221, a second input circuit 222 and a sensing circuit 223. The first input circuit 221 is connected to the first terminal of the driving sub-circuit DS and the sensing circuit 223. The second input circuit 222 is connected to a control terminal of the driving sub-circuit DS. The sensing circuit 223 is further connected to the controller 21 and the first terminal of the driving sub-circuit DS. The controller 21 is further connected to the control terminal of the driving sub-circuit DS.

For example, the driving sub-circuit DS includes the driving transistor DT, the first electrode of the driving transistor DT is the first terminal of the driving sub-circuit DS, the control electrode of the driving transistor DT is the control terminal of the driving sub-circuit DS, and the second electrode of the driving transistor DT is a second terminal of the driving sub-circuit DS.

For example, referring to FIG. 5 or 6, the structure of the pixel driving circuit 101 is of "3T1C". The first input circuit 221 and the sensing circuit 223 are connected to the first electrode of the driving transistor DT through the second transistor T2, and the second input circuit 222 and the controller 21 are connected to the control electrode of the driving transistor DT through the first transistor T1.

It will be noted that, the description "the controller 21 being connected to the control electrode of the driving transistor DT through the first transistor T1" may be, for example, the controller 21 being connected to the control electrode of the driving transistor DT only through the first transistor T1 (as shown in FIG. 5).

Alternatively, as shown in FIG. 6, the controller 21 may also be connected to the control electrode of the driving transistor DT through the second input circuit 222 and the first transistor T1 in sequence.

The first input circuit 221 is configured to: transmit a first voltage V1 to the first electrode of the driving transistor DT in the initialization phase; perform blanking in the pre-storage phase; and transmit a threshold compensation voltage ΔV to the first electrode of the driving transistor DT in the data compensation writing phase. The second input circuit 222 is configured to transmit a second voltage V2 to the control electrode of the driving transistor DT in the initialization phase and the pre-storage phase, so that a voltage of the first electrode of the driving transistor DT changes from the first voltage V1 to the threshold compensation voltage ΔV in the pre-storage phase.

The first voltage V1 and the threshold compensation voltage ΔV are both less than a turn-on voltage of the light-emitting device PD. Thus, it is ensured that the light-emitting device PD does not emit light in the initialization phase, the pre-storage phase and the data compensation writing phase. The threshold compensation voltage ΔV is equal to a difference between the second voltage V2 and the threshold voltage $V_{th}$ of the driving transistor DT. That is $\Delta V = V2 - V_{th}$.

The sensing circuit 223 is configured to: sense the threshold compensation voltage ΔV in the data compensation writing phase; and transmit the threshold compensation voltage ΔV to the first input circuit 221.

The controller 21 is configured to transmit a data voltage to the control electrode of the driving transistor DT in the data compensation writing phase.

For example, the data voltage is a voltage corrected by the controller 21 according to an actual characteristic value of the driving sub-circuit DS determined in a previous light-emitting driving period.

For example, the sensing circuit 223 is further connected to the controller 21, and the sensing circuit 223 is further configured to: sense a first current $I_{2-1}$ transmitted by the first electrode of the driving transistor DT and transmit the first current $I_{2-1}$ to the controller 21 in the initialization phase; and transmit the sensed threshold compensation voltage ΔV to the controller 21 in the data compensation writing phase. The controller 21 is further configured to: determine the actual characteristic value of the driving transistor DT according to the first current $I_{2-1}$ and the threshold compensation voltage ΔV and correct a data voltage to be transmitted in a next data compensation writing phase according to the actual characteristic value.

Figure 7:
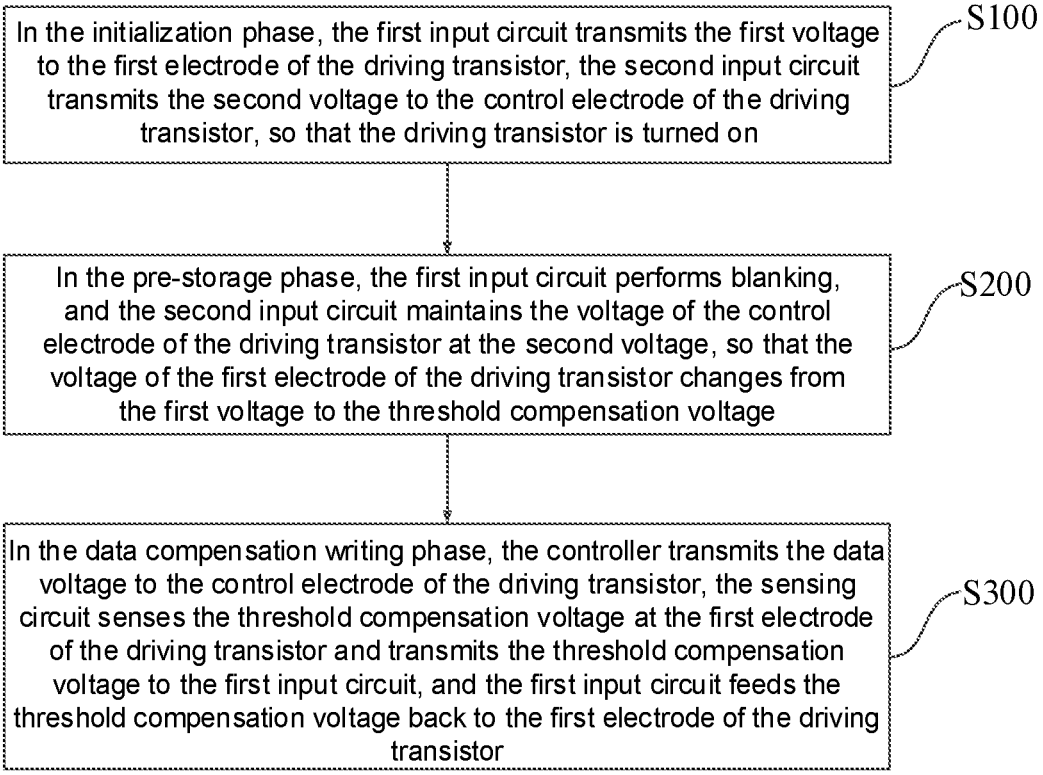
FIG. 7 is a flow diagram of a pixel compensation method, in accordance with some embodiments of the present disclosure.

The pixel compensation device 2 in some embodiments of the present disclosure adopts a pixel compensation method described below to compensate each sub-pixel PX of the display substrate 1. Referring to FIG. 7, the pixel compensation method includes S100 to S300.

In S100, in the initialization phase, the first input circuit 221 transmits the first voltage V1 to the first electrode of the driving transistor DT, the second input circuit 222 transmits the second voltage to the control electrode of the driving transistor DT, so that the driving transistor DT is turned on.

For example, referring to FIG. 5, in the initialization phase, the first transistor T1 is turned on in response to a first gate scanning signal from the first scanning signal line G1, the second transistor T2 is turned on in response to a second gate scanning signal from the second scanning signal line G2, the first input circuit 221 transmits the first voltage V1 to the first electrode of the driving transistor DT and the second electrode of the first capacitor C0 through the second transistor T2, and the second input circuit 222 transmits the second voltage V2 to the control electrode of the driving transistor DT and the first electrode of the first capacitor C0 through the first transistor T1. In this way, the driving transistor DT is turned on, the first capacitor C0 is charged, and a voltage of the first electrode of the first capacitor C0 is equal to the second voltage V2, and a voltage of the second electrode of the first capacitor C0 is equal to the first voltage V1.

In this case, a gate-source voltage difference $V_{gs}$ of the driving transistor DT is equal to a difference between the second voltage V2 and the first voltage V1. That is, $V_{gs}$=V2−V1. In addition, an absolute value of the gate-source voltage difference $V_{gs}$ of the driving transistor DT is greater than an absolute value of the threshold voltage of the driving transistor DT, so that the driving transistor is turned on.

In S200, in the pre-storage phase, the first input circuit 221 performs blanking, and the second input circuit 222 maintains the voltage of the control electrode of the driving transistor DT at the second voltage V2, so that the voltage of the first electrode of the driving transistor DT changes from the first voltage V1 to the threshold compensation voltage ΔV.

Here, the first input circuit 221 performs blanking, which means that the first input circuit 221 is disconnected from relevant voltage terminal(s) (e.g., a first voltage terminal U1 shown in FIG. 5) and does not transmit the first voltage V1 or other signals to the driving transistor DT.

For example, with continued reference to FIG. 5, in the pre-storage phase, the first transistor T1 is turned on in response to the first gate scanning signal, the second transistor T2 is turned on in response to the second gate scanning signal, the first input circuit 221 performs blanking, and the second input circuit 222 continuously transmits the second voltage V2 to the control electrode of the driving transistor DT through the first transistor T1. The second voltage controls the driving transistor DT to be turned on. The first power voltage terminal VDD pulls up the voltage of the first electrode of the driving transistor DT until the driving transistor DT reaches a critical state between a turn-on state and turn-off state, and thus the voltage of the first electrode of the driving transistor DT is stabilized at the threshold compensation voltage ΔV (i.e., the difference between the second voltage and the threshold voltage of the driving transistor DT). The threshold compensation voltage ΔV is simultaneously written into the second electrode of the first capacitor C0.

In S300, in the data compensation writing phase, the controller 21 transmits the data voltage to the control electrode of the driving transistor DT, the sensing circuit 223 senses the threshold compensation voltage ΔV at the first electrode of the driving transistor DT and transmits the threshold compensation voltage ΔV to the first input circuit 221, and the first input circuit 221 feeds the threshold compensation voltage ΔV back to the first electrode of the driving transistor DT.

For example, the data voltage may be a voltage corrected by the controller 21 according to the actual characteristic value of the driving transistor DT determined in a previous light-emitting driving period.

For example, with continued reference to FIG. 5, in the data compensation writing phase, the first transistor T1 is turned on in response to the first gate scanning signal, the second transistor T2 is turned on in response to the second gate scanning signal, the controller 21 transmits the data voltage to the control electrode of the driving transistor DT and the first electrode of the first capacitor C0 through the first transistor T1, the sensing circuit 223 senses the threshold compensation voltage ΔV at the first electrode of the driving transistor DT through the second transistor T2 and transmits the threshold compensation voltage ΔV to the first input circuit 221, and the first input circuit 221 feeds the threshold compensation voltage ΔV back to the first electrode of the driving transistor DT. In this way, the voltage of the first electrode of the driving transistor DT is maintained at the threshold compensation voltage ΔV. In this case, the gate-source voltage difference of the driving transistor DT is equal to ($V_{data}$−V2+$V_{th}$) (i.e., $V_{gs}$=$V_{data}$−V2+$V_{th}$), and the $V_{data}$ represents the data voltage.

In this way, in a light-emitting phase, an output current of the driving transistor DT (i.e., a light-emitting current $I_{light\text{-}emitting}$ of the light-emitting device PD) is: $I_{light\text{-}emitting}=K(V_{gs}-V_{th})^2=K(V_{data}-V2)^2$. It can be seen that, the light-emitting current $I_{light\text{-}emitting}$ of the light-emitting device PD is irrelevant to the threshold voltage of the driving transistor DT. That is, the pixel compensation device 2 of the above embodiments achieves the compensation of the threshold voltage $V_{th}$ of the driving transistor DT.

Figure 8:
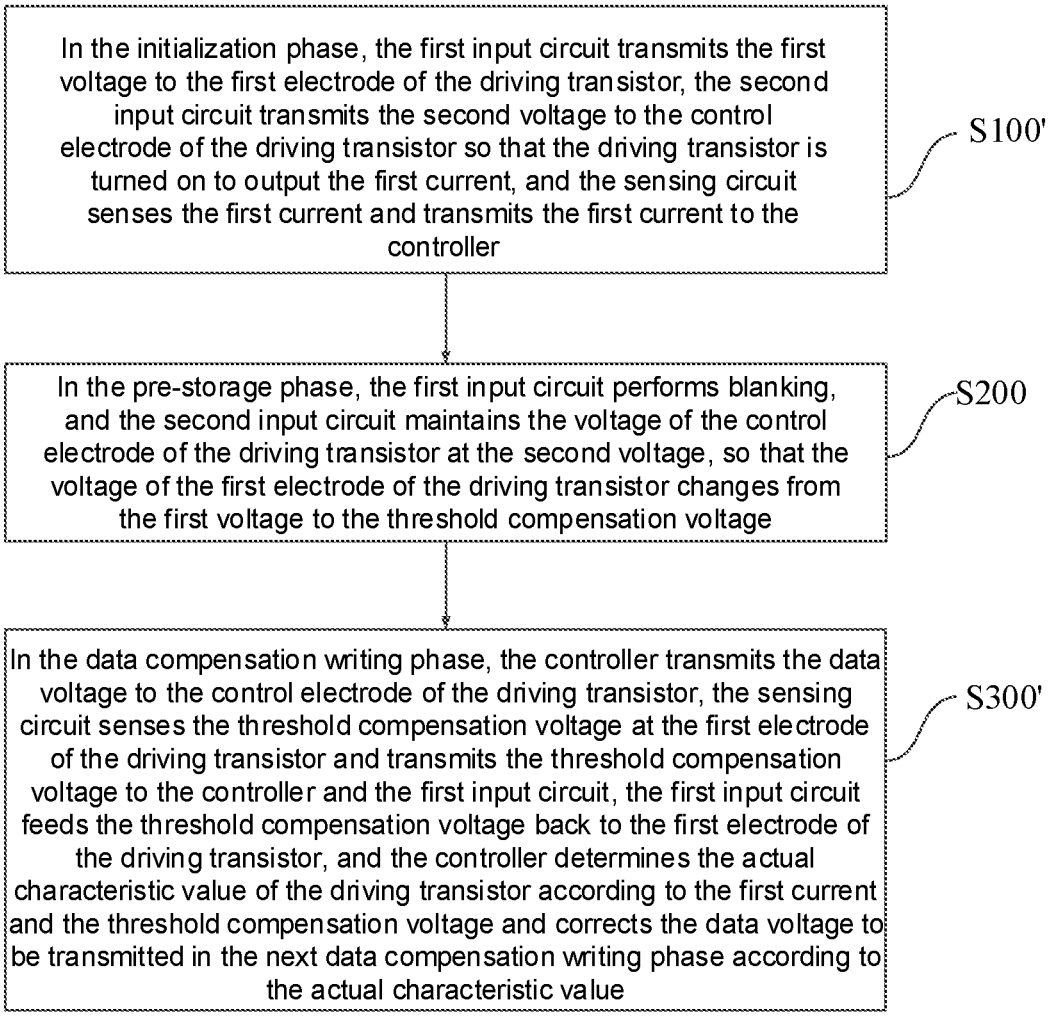
FIG. 8 is a flow diagram of another pixel compensation method, in accordance with some embodiments of the present disclosure.

In some other embodiments, referring to FIG. 8, in another pixel compensation method, S100 is replaced by S100' and S300 is replaced by S300' based on S100 to S300 of the above embodiments.

In S100', in the initialization phase, the first input circuit 221 transmits the first voltage V1 to the first electrode of the driving transistor DT, the second input circuit 222 transmits the second voltage V2 to the control electrode of the driving transistor DT so that the driving transistor DT is turned on to output the first current $I_{2\text{-}1}$, and the sensing circuit 223 senses the first current $I_{2\text{-}1}$ and transmits the first current $I_{2\text{-}1}$ to the controller 21.

For example, referring to FIG. 5, in the initialization phase, the first transistor T1 is turned on in response to the first gate scanning signal, the second transistor T2 is turned on in response to the second gate scanning signal, the first input circuit 221 transmits the first voltage V1 to the first electrode of the driving transistor DT and the second electrode of the first capacitor C0 through the second transistor T2, the second input circuit 222 transmits the second voltage V2 to the control electrode of the driving transistor DT and the first electrode of the first capacitor C0 through the first transistor T1. In this way, the driving transistor DT is turned on to output the first $I_{2\text{-}1}$; the first capacitor C0 is charged, the voltage of the first electrode of the first capacitor C0 is equal to the second voltage V2, and the voltage of the second electrode of the first capacitor C0 is equal to the first voltage V1, and the sensing circuit 223 senses the first current $I_{2\text{-}1}$ through the second transistor T2 and transmits the first $I_{2\text{-}1}$ to the controller 21.

In this case, the gate-source voltage difference $V_{gs}$ of the driving transistor DT is equal to the difference between the second voltage V2 and the first voltage V1. That is, $V_{gs}$=V2−V1. In addition, the absolute value of the gate-source voltage difference $V_{gs}$ of the driving transistor DT is greater than the absolute value of the threshold voltage of the driving transistor DT, so that the driving transistor is turned on to output the first current $I_{2\text{-}1}$.

It can be easily understood that, the first current $I_{2\text{-}1}$ and the gate-source voltage difference $V_{gs}$ of the driving transistor DT satisfy the formula: $I_{2\text{-}1}K(V_{gs}-V_{th})^2$. Therefore, $I_{2\text{-}1}=K(V2-V1-V_{th})^2$, where the $I_{2\text{-}1}$ represents the first current, and the K represents the actual characteristic value of the driving transistor DT. Thus, according to the first current $I_{2-1}$, the first voltage V1, the second voltage V2 and the subsequently determined threshold voltage $V_{th}$ of the driving transistor DT, the actual characteristic value of the driving transistor DT may be determined.

In S300', in the data compensation writing phase, the controller 21 transmits the data voltage to the control electrode of the driving transistor DT, the sensing circuit 223 senses the threshold compensation voltage ΔV at the first electrode of the driving transistor DT and transmits the threshold compensation voltage ΔV to the controller 21 and the first input circuit 221, the first input circuit 221 feeds the threshold compensation voltage ΔV back to the first electrode of the driving transistor DT, and the controller 221 determines the actual characteristic value of the driving transistor according to the first current $I_{2-1}$ and the threshold compensation voltage ΔV and corrects the data voltage to be transmitted in the next data compensation writing phase according to the actual characteristic value.

For example, the data voltage may be the voltage corrected by the controller 21 according to the actual characteristic value of the driving transistor DT determined in the previous light-emitting driving period.

For example, with continued reference to FIG. 5, in the data compensation writing phase, the first transistor T1 is turned on in response to the first gate scanning signal, the second transistor T2 is turned on in response to the second gate scanning signal, the controller 21 transmits the data voltage to the control electrode of the driving transistor DT and the first electrode of the first capacitor C0 through the first transistor T1, the sensing circuit 223 senses the threshold compensation voltage ΔV at the first electrode of the driving transistor DT through the second transistor T2 and transmits the threshold compensation voltage ΔV to the first input circuit 221 and the controller 21, and the first input circuit 221 feeds the threshold compensation voltage ΔV back to the first electrode of the driving transistor DT. In this way, the voltage of the first electrode of the driving transistor DT is maintained at the threshold compensation voltage ΔV. In this case, the gate-source voltage difference of the driving transistor DT is: $V_{gs}=V_{data}-V2+V_{th}$; and the $V_{data}$ represents the data voltage.

With this design, in addition to achieving the compensation of the threshold voltage $V_{th}$, the controller 21 may further determine the actual characteristic value of the driving transistor DT according to the received first current $I_{2-1}$ and the threshold compensation voltage ΔV and correct the data voltage $V_{data}$ to be transmitted in the next data compensation writing phase according to the actual characteristic value.

For example, specific values of the first voltage V1, the second voltage V2 and an original characteristic value K0 of the driving transistor DT are pre-stored in the controller 21. A specific value of the threshold voltage $V_{th}$ of the driving transistor DT may be firstly determined according to the received threshold compensation voltage ΔV (i.e., $V2-V_{th}$); and then, according to the received first current $I_{2-1}$, the actual characteristic value of the driving transistor DT may be determined by the formula: $I_{2-1}=K(V2-V1-V_{th})^2$. Furthermore, according to a difference between the actual characteristic value K of the driving transistor DT and the original characteristic value K0 of the driving transistor DT, the data voltage to be transmitted in the next data compensation writing phase may be corrected according to a relevant formula or a corresponding relationship.

In some examples, referring to FIG. 2, the controller 21 is connected to a plurality of external compensation circuits 22, and the external compensation circuit 22 is connected to pixel driving circuits 101. For example, different sensing circuits 223 in different external compensation circuits 22 or the same external compensation circuit 22 sense the first $I_{2-1}$ for the same duration.

That is, durations for which all sensing circuits 223 in the pixel compensation device 2 sense the first current $I_{2-1}$ are uniformly set to be the same fixed value. In this way, it is beneficial to reduce a sensing deviation caused by different sensing durations of the sensing circuits 223 and improve overall accuracy of a sensing signal (i.e., accuracy of the sensed first $I_{2-1}$), and thus effectively ensure accuracy of the compensation of the characteristic value of the driving transistor DT.

Thus, in the single light-emitting driving period, the pixel compensation device 2 in the embodiments described above may enable the pixel driving circuit 101 to generate the corresponding threshold compensation voltage ΔV at the first electrode of the driving transistor DT according to the second voltage V2 provided by the second input circuit 222, and feed the threshold compensation voltage ΔV back to the first electrode of the driving transistor DT through the sensing circuit 223 and the first input circuit 221 in real time, thereby achieving the compensation of the threshold voltage of the driving transistor DT. In addition, the threshold compensation voltage may be further transmitted to the controller 21 through the sensing circuit 223, and the sensing circuit 223 may further sense the first $I_{2-1}$ output by the driving transistor DT in the initialization phase and transmit the first $I_{2-1}$ to the controller 21. The first $I_{2-1}$ is an output current in a case where the voltage of the control electrode of the driving transistor DT is the second voltage V2 and the voltage of the first electrode of the driving transistor DT is the first voltage V1. Therefore, the controller 21 is able to determine the actual characteristic value of the driving transistor DT according to the first current $I_{2-1}$ and the threshold compensation voltage ΔV, and correct the data voltage to be written according to the actual characteristic value in the next data compensation writing phase to achieve the compensation of the characteristic value of the driving transistor DT. That is, the pixel compensation device 2 in the embodiments described above may compensate the pixel driving circuit 101 in terms of the threshold voltage and the characteristic value of the driving transistor DT, thereby effectively improving the accuracy of the compensation and ensuring a uniform display effect of the display apparatus 3.

It will be noted that, in the pixel compensation device 2 provided in some embodiments of the present disclosure, the sensing circuit 223 is connected to the first electrode of the driving transistor DT and the light-emitting device PD. Therefore, in addition to being configured to sense a signal relevant to the driving transistor DT (e.g., the first current $I_{2-1}$ or the threshold compensation voltage ΔV), the sensing circuit 223 may be further configured to sense a signal relevant to the light-emitting device PD. For example, the sensing circuit 223 may be further configured to sense a discharge current of the light-emitting device PD.

In some embodiments, the light-emitting driving period further includes an aging sensing phase. The second input circuit 222 is further configured to transmit a third voltage to the control electrode of the driving transistor DT in the aging sensing phase, so as to control the driving transistor DT to be turned off. The sensing circuit 223 is further configured to sense a second current transmitted from the light-emitting device PD to the first electrode of the driving transistor DT in the aging sensing phase and transmits the second current to the controller 21. The controller 21 is further configured to: determine aging information of the light-emitting device PD according to the second current; and correct the data voltage to be transmitted in the next data compensation writing phase according to the aging information.

Figure 9:
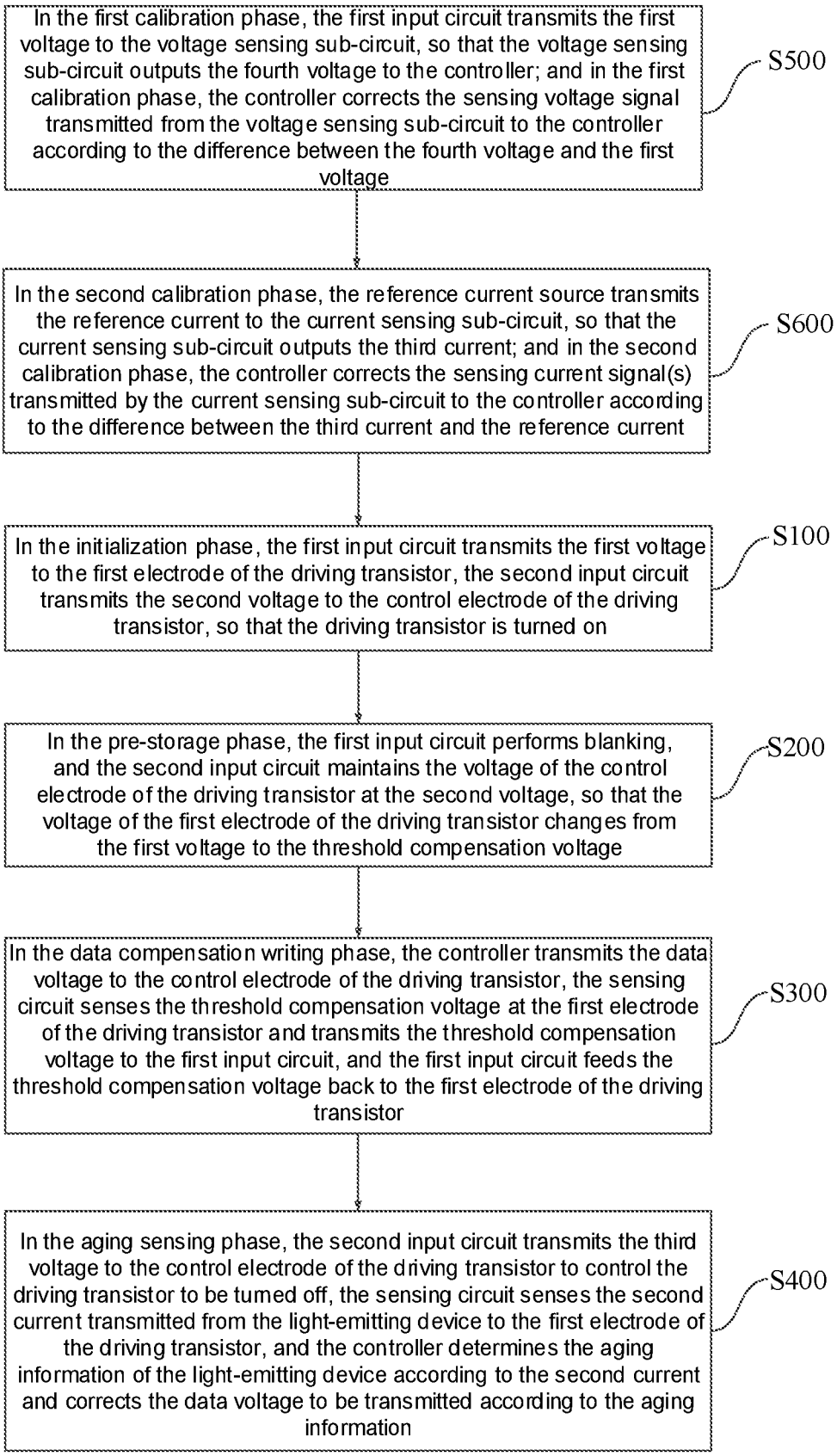
FIG. 9 is a flow diagram of yet another pixel compensation method, in accordance with some embodiments of the present disclosure.
Figure 10:
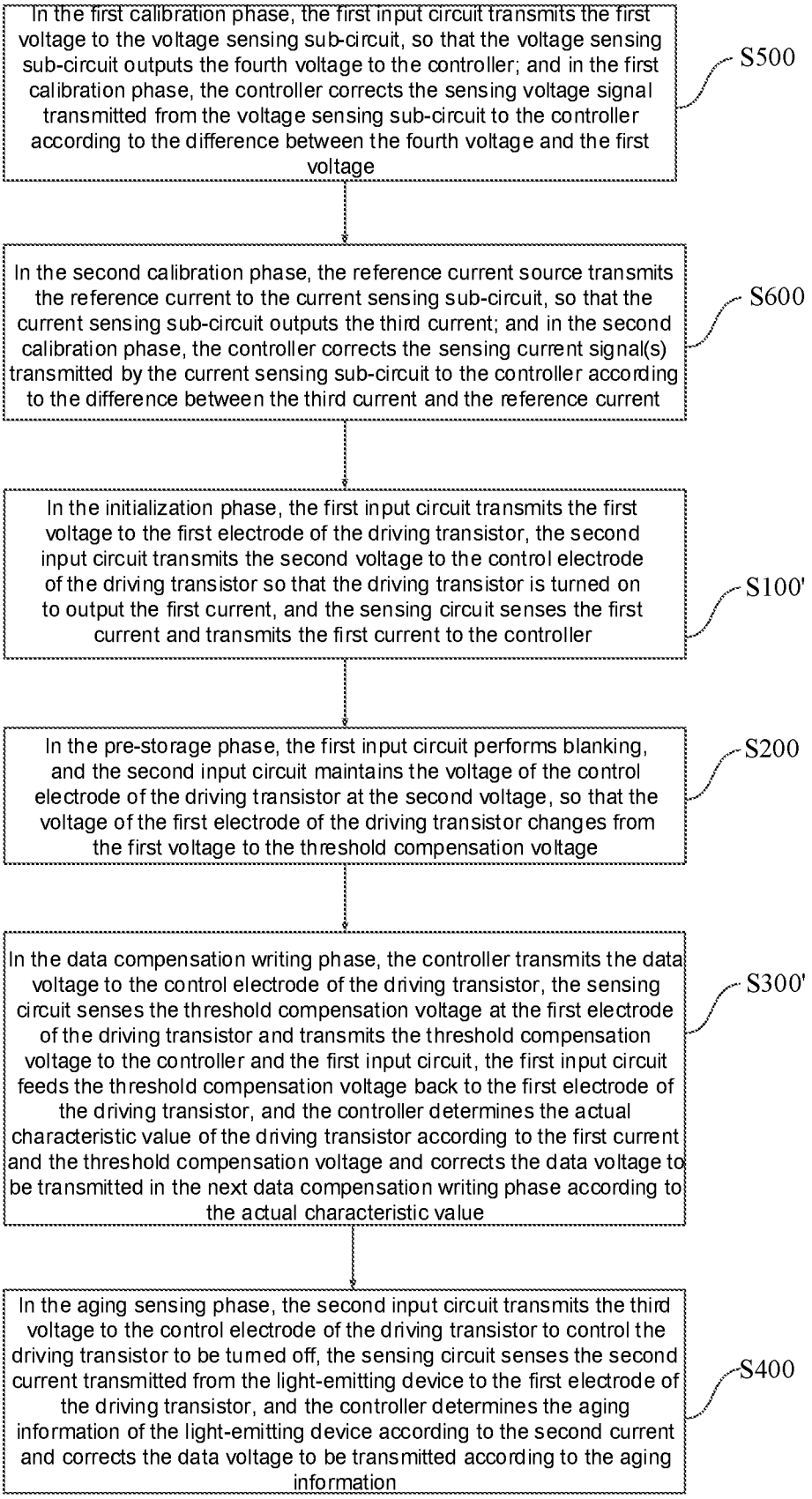
FIG. 10 is a flow diagram of yet another pixel compensation method, in accordance with some embodiments of the present disclosure.

Correspondingly, referring to FIG. 9 or 10, in some embodiments of the present disclosure, the pixel compensation method adopted by the pixel compensation device 2 further includes S400 on the basis of including the S100 to the S300 or including the S100', the S200 and the S300'.

In S400, in the aging sensing phase, the second input circuit 222 transmits the third voltage to the control electrode of the driving transistor DT to control the driving transistor DT to be turned off, the sensing circuit 223 senses the second current transmitted from the light-emitting device PD to the first electrode of the driving transistor DT, and the controller 21 determines the aging information of the light-emitting device PD according to the second current and corrects the data voltage to be transmitted according to the aging information.

Here, the aging sensing phase immediately follows the light-emitting phase, and the driving transistor DT does not output any signal to the light-emitting device PD. The light-emitting device PD discharges by itself relying on electric charges remained after emitting light, thereby generating a discharge current, i.e. the second current. The second current is relevant to an aging degree of the light-emitting device PD.

It will be noted that, the third voltage is configured to turn off the driving transistor DT. The third voltage may be at a low level or a high level, which is determined according to the type of the driving transistor DT. For example, the driving transistor DT is the P-type transistor, and the third voltage is at the high level. For another example, the driving transistor DT is the N-type transistor, and the third voltage is at the low level.

For example, referring to FIG. 5, in the aging sensing phase, the first transistor T1 is turned on in response to the first gate scanning signal, the second transistor T2 is turned on in response to the second gate scanning signal, the second input circuit 222 transmits the third voltage to the control electrode of the driving transistor DT through the first transistor T1 to control the driving transistor DT to be turned off, and the sensing circuit 223 senses the second current at the first electrode of the driving transistor DT through the second transistor T2 and transmits the second current to the controller 21. Thus, the controller 21 may determine the aging information of the light-emitting device PD according to the second current, so as to correct the data voltage to be transmitted.

Thus, in addition to compensating the threshold voltage and the characteristic value of the driving transistor DT, the pixel compensation device 2 provided in some embodiments described above may further perform the aging compensation on the light-emitting device PD. Therefore, the effect of the pixel compensation is further improved, and the display effect of the display apparatus 3 is ensured to be uniform.

It will be noted that, since a relevant voltage of the light-emitting device PD (e.g., a voltage of the anode of the OLED) does not have a clear and fixed relationship with its light-emitting efficiency, an approximate fitting relationship curve may be obtained only through a number of test experiments in the related art, but the fitting relationship curve has no reusability for different display substrates 1. However, a relevant current (including the light-emitting current or the discharge current) of the light-emitting device PD has a linear relationship with its light-emitting efficiency, and the relationship between the relevant current and the light-emitting efficiency of the light-emitting device PD is more direct and accurate. In this way, the corresponding relationship between the relevant current and the light-emitting efficiency of the light-emitting device PD may be determined through less test experiments. Therefore, compared with the way of performing the aging compensation on the light-emitting device PD by sensing the relevant voltage of the light-emitting device PD (e.g., the voltage of the anode of the OLED) in the related art, the pixel compensation device 2 in some embodiments of the present disclosure performs the aging compensation on the light-emitting device PD by sensing its discharge current, which may obtain a more accurate effect of the aging compensation with a more simplified way.

It can be understood that, since an aging process of the light-emitting device PD is usually slow, aging sensing of the light-emitting device PD may be performed at certain time intervals. A specific time interval may be determined according to actual situations.

For example, an aging test is performed on the light-emitting device PD every three days. For example, an aging sensing phase in a specific light-emitting driving period is set as an effective phase; in this case, the pixel compensation device 2 performs functions of the aging sensing and the compensation. Aging sensing phases in other light-emitting driving periods are set as ineffective phases; in this case, the pixel compensation device 2 does not perform the functions of the aging sensing and the compensation, but skips these phases and executes a function of a next corresponding phase.

In some examples, referring to FIG. 2, the controller 21 is connected to the plurality of external compensation circuits 22, and the external compensation circuit 22 is connected to the pixel driving circuits 101. For example, different sensing circuits 223 in the different external compensation circuits 22 or the same external compensation circuit 22 sense the second current for the same duration.

That is, durations for which all sensing circuits 223 in the pixel compensation device 2 sense the second current are uniformly set to be the same fixed value. In this way, it is beneficial to reduce the sensing deviation caused by different sensing durations of the sensing circuits 223 and improve the overall accuracy of the sensing signal (i.e., the accuracy of the sensed second current), and thus effectively ensure an accuracy of the aging compensation of the light-emitting device PD.

It will be noted that, the functions of the sensing circuit 223 are as described above, and the specific structure thereof may be determined according to actual needs, which is not limited in the embodiments of the present disclosure.

Figure 11:
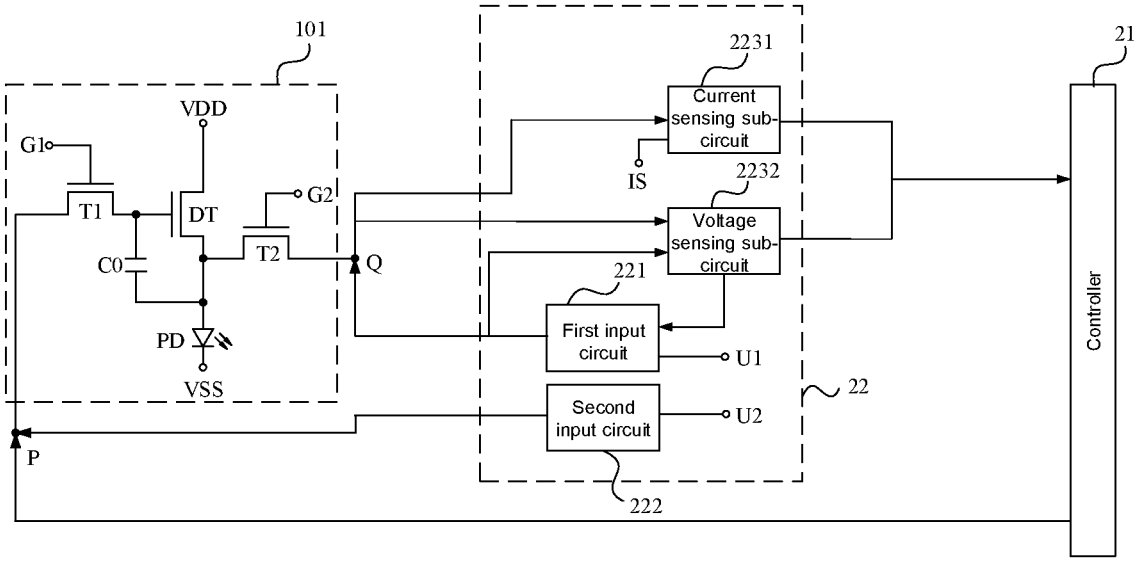
FIG. 11 is a structural diagram of yet another pixel compensation device, in accordance with some embodiments of the present disclosure.

In some embodiments, referring to FIG. 11, the sensing circuit 223 includes a voltage sensing sub-circuit 2232. The voltage sensing sub-circuit 2232 is connected to the first electrode of the driving transistor DT and the first input circuit 221. The voltage sensing sub-circuit 2232 is configured to, in the data compensation writing phase, sense the threshold compensation voltage at the first electrode of the driving transistor DT and transmit the threshold compensation voltage to the first input circuit 221.

In some examples, with continued reference to FIG. 11, the voltage sensing sub-circuit 2232 is further connected to the controller 21. The voltage sensing sub-circuit is further configured to, in the data compensation writing phase, sense the threshold compensation voltage $\Delta V$ and transmit the threshold compensation voltage $\Delta V$ to the controller 21.

It will be noted that, the structure of the voltage sensing sub-circuit 2232 may vary.

Figure 13:
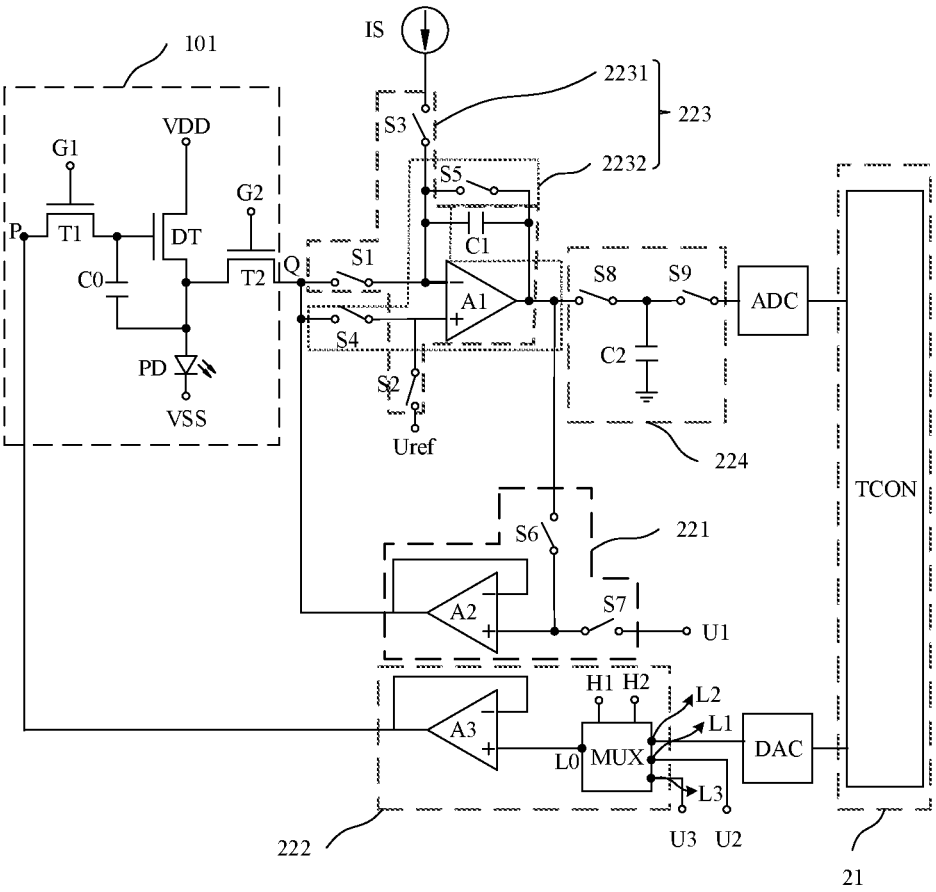
FIG. 13 is a structural diagram of yet another pixel compensation device, in accordance with some embodiments of the present disclosure.

For example, referring to FIG. 13, the voltage sensing sub-circuit 2232 includes a first operational amplifier A1, a fourth switch S4 and a fifth switch S5. A non-inverting input terminal of the first operational amplifier A1 is connected to the first electrode of the driving transistor DT through the fourth switch S4, and an inverting input terminal of the first operational amplifier A1 is connected to an output terminal of the first operational amplifier A1 through the fifth switch S5.

In some examples, with continued reference to FIG. 11, the sensing circuit further includes a current sensing sub-circuit 2231. The current sensing sub-circuit 2231 is connected to the first electrode of the driving transistor DT and the controller 21. The current sensing sub-circuit 2231 is configured to: sense the first current $I_{2-1}$ at the first electrode of the driving transistor DT and transmit the first current $I_{2-1}$ to the controller 21 in the initialization phase; and/or, sense the second current at the first electrode of the driving transistor DT and transmit the second current to the controller 21 in the aging sensing phase.

It will be noted that, the structure of the current sensing sub-circuit 2231 may vary.

In some examples, referring to FIG. 13, the current sensing sub-circuit 2231 includes the first operational amplifier A1, an integrating capacitor C1, a first switch S1, and a second switch S2. The non-inverting input terminal of the first operational amplifier A1 is connected to a reference voltage terminal Uref through the second switch S2, and the inverting input terminal of the first operational amplifier A1 is connected to the first electrode of the driving transistor DT through the first switch S1. The inverting input terminal of the first operational amplifier A1 is further connected to a first electrode of the integrating capacitor C1. The output terminal of the first operational amplifier A1 is connected to a second electrode of the integrating capacitor C1 and the controller 21.

For example, with continued reference to FIG. 13, the current sensing sub-circuit 2231 may further include a third switch S3, and the third switch S3 is connected to the inverting input terminal of the first operational amplifier A1 and a reference current source IS.

For example, the reference current source IS may be further connected to a relevant voltage terminal (not shown in the drawings), so as to ensure a normal working state of the reference current source IS.

It will be noted that, in some embodiments described above, the voltage sensing sub-circuit 2232 and the current sensing sub-circuit 2231 may share the first operational amplifier A1.

It can be easily understood that, in order to ensure the accuracies of the sensing signals, the sensing circuit 223 (including the voltage sensing sub-circuit 2232 and the current sensing sub-circuit 2231) needs to be calibrated periodically, so as to make itself have a good sensing precision. In the pixel compensation device 2 in some embodiments of the present disclosure, the first input circuit 221 is connected to the voltage sensing sub-circuit 2232. With this design, the first input circuit 221 may be configured to provide a voltage input signal to the sensing circuit 223, so as to assist the sensing circuit 223 in realizing the calibration.

In some embodiments, the light-emitting driving period further includes a first calibration phase. The first input circuit 221 is further configured to transmit the first voltage to the voltage sensing sub-circuit 2232 in the first calibration phase, so that the voltage sensing sub-circuit 2232 outputs a fourth voltage to the controller 21. The controller 21 is further configured to correct a sensing voltage signal transmitted from the voltage sensing sub-circuit 2232 to the controller 21 according to a difference between the fourth voltage and the first voltage. The sensing voltage signal includes the threshold compensation voltage.

Correspondingly, referring to FIG. 9 or 10, in some embodiments of the present disclosure, the pixel compensation method adopted by the pixel compensation device 2 further includes S500.

In S500, in the first calibration phase, the first input circuit 221 transmits the first voltage to the voltage sensing sub-circuit 2232, so that the voltage sensing sub-circuit 2232 outputs the fourth voltage to the controller 21; and in the first calibration phase, the controller 21 corrects the sensing voltage signal transmitted from the voltage sensing sub-circuit 2232 to the controller 21 according to the difference between the fourth voltage and the first voltage.

Thus, in the pixel compensation device 2 in some embodiments described above provides, the input signal required for the calibration is provided to the voltage sensing sub-circuit 2232 by using the first input circuit 221. Compared with providing the input signal required for the calibration to the voltage sensing sub-circuit 2232 by adding another external voltage terminal, the pixel compensation device 2 in some embodiments of the present disclosure may omit a corresponding external voltage terminal and a corresponding signal line and save a space, thereby facilitating a narrow bezel design of the display apparatus 3.

In some embodiments, the light-emitting driving period further includes a second calibration phase. The current sensing sub-circuit 2231 is further connected to the reference current source IS. The reference current source IS is configured to transmit a reference current to the current sensing sub-circuit 2231 in the second calibration phase, so that the current sensing sub-circuit 2231 outputs a third current. The controller 21 is further configured to correct sensing current signal(s) transmitted by the current sensing sub-circuit 2231 to the controller 21 according to a difference between the third current and the reference current. The sensing current signal(s) includes the first current and/or the second current.

Correspondingly, with continued reference to FIG. 9 or 10, the pixel compensation method in some embodiments of the present disclosure further includes S600.

In S600, in the second calibration phase, the reference current source IS transmits the reference current to the current sensing sub-circuit 2231, so that the current sensing sub-circuit 2231 outputs the third current; and in the second calibration phase, the controller 21 corrects the sensing current signal(s) transmitted by the current sensing sub-circuit 2231 to the controller 21 according to the difference between the third current and the reference current.

It will be noted that, since a process of the voltage sensing sub-circuit 2232 and the current sensing sub-circuit 2231 from calibration to offset (accuracy thereof becoming worse) are usually slow, the calibration of the voltage sensing sub-circuit 2232 and/or the calibration of the current sensing sub-circuit 2231 may be performed at certain time intervals. A specific time interval may be determined according to actual situations. For example, the calibrations of the voltage sensing sub-circuit 2232 and the current sensing sub-circuit 2231 may be performed every three days. For example, a first calibration phase or a second calibration phase in a specific light-emitting driving period is set as an effective phase; in this case, the pixel compensation device 2 performs a function of the calibration of the voltage sensing sub-circuit 2232 or the calibration of the current sensing sub-circuit 2231. First calibration phases or the second calibration phases in other light-emitting driving periods are set as ineffective phases; in this case, the pixel compensation device 2 does not perform the function of the calibration of the voltage sensing sub-circuit 2232 or the calibration of the current sensing sub-circuit 2231.

In some examples, the first calibration phase or the second calibration phase may be set within a standby time period of the display apparatus 3. Here, the standby time period refers to a time period during which the display apparatus 3 displays a black image.

In this way, the calibrations of the voltage sensing sub-circuit 2232 and the current sensing sub-circuit 2231 may be completed without affecting normal display of the display apparatus 3 to ensure a stability of the display process.

Figure 12:
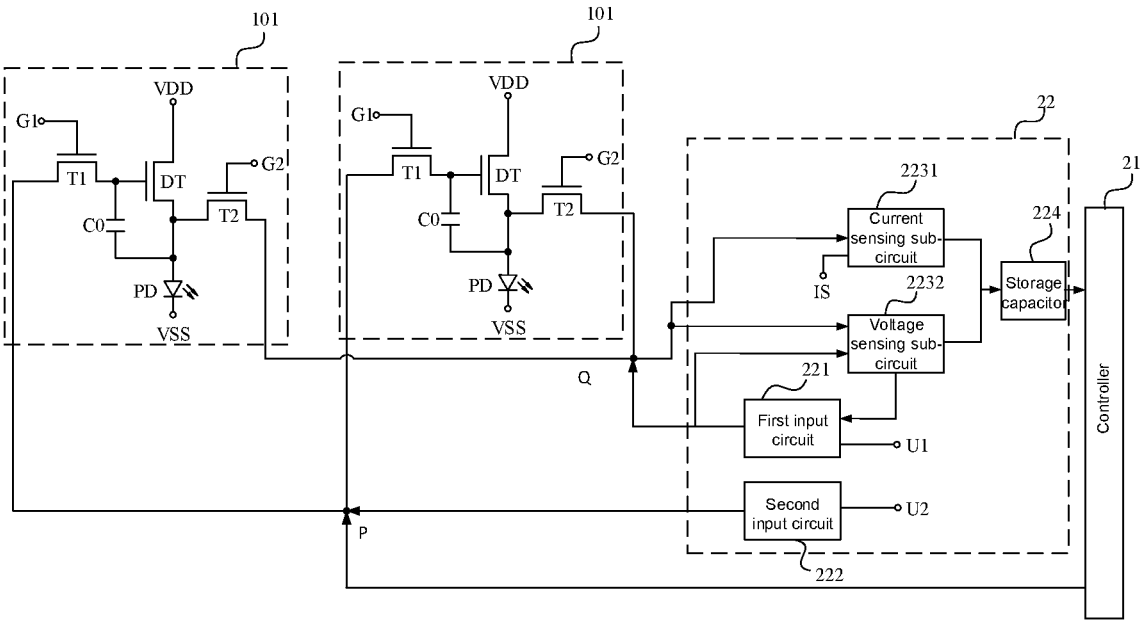
FIG. 12 is a structural diagram of yet another pixel compensation device, in accordance with some embodiments of the present disclosure.

It will be noted that, referring to FIG. 12, in a case where the external compensation circuit 22 is connected to the pixel driving circuits 101 of sub-pixels PX (e.g., two sub-pixels PX), the external compensation circuit 22 further includes a storage circuit 224. The storage circuit 224 is connected between the sensing circuit 223 and the controller 21. The storage circuit 224 is configured to store sensing signal(s) output by the sensing circuit 223, and transmit the sensing signal(s) to the controller 21 in response to an output control signal. The sensing signal(s) includes at least the threshold compensation voltage.

In some examples, the sensing signal(s) may further include at least one of the first current, the second current, the third current and the fourth voltage.

It can be easily understood that, the pixel compensation circuit may make a data processing time period of the controller 21 and a signal sensing time period of the sensing circuit 223 time-staggered by using a temporary data storage function of the storage circuit 224, and make the sensing circuit 223 output the sensing signal to the controller 21 when needed. In this way, the controller 21 may have more sufficient time to process relevant data, which may effectively reduce operating pressures of the controller 21 and even the display apparatus 3 in a case where a sensing efficiency of the sensing circuit 223 is ensured.

For example, in a first sub-phase of the initialization phase, the sensing circuit 223 senses the first current and temporarily stores the first current in the storage circuit 224. In a second sub-phase of the initialization phase, the storage circuit 224 transmits the first current to the controller 21 in response to a corresponding output control signal.

For example, in a first sub-phase of the data compensation writing phase, the sensing circuit 223 senses the threshold compensation voltage and temporarily stores the threshold compensation voltage in the storage circuit 224. In a second sub-phase of the data compensation writing phase, the storage circuit 224 transmits the threshold compensation voltage to the controller 21 in response to a corresponding output control signal.

For example, in a first sub-phase of the aging sensing phase, the sensing circuit 223 senses the second current and temporarily stores the second current in the storage circuit 224. In a second sub-phase of the aging sensing phase, the storage circuit 224 transmits the second current to the controller 21 in response to a corresponding output control signal.

For example, in a first sub-phase of the first calibration phase, the voltage sensing sub-circuit 2232 outputs the fourth voltage and temporarily stores the fourth voltage in the storage circuit 224. In a second sub-phase of the first calibration phase, the storage circuit 224 transmits the fourth voltage to the controller 21 in response to a corresponding output control signal.

For example, in a first sub-phase of the second calibration phase, the current sensing sub-circuit 2231 senses the third current and temporarily stores the third current in the storage circuit 224. In a second sub-phase of the second calibration phase, the storage circuit 224 transmits the third current to the controller 21 in response to a corresponding output control signal.

It will be noted that, the function of the storage circuit 224 is as described above, and the specific structure thereof may be determined according to actual needs, which is not limited in the embodiments of the present disclosure.

In some embodiments, with continued reference to FIG. 13, the storage circuit 224 includes a storage capacitor C2, an eighth switch S8 and a ninth switch S9. The sensing circuit 223 is connected to a first electrode of the storage capacitor C2 through the eighth switch S8. The controller 21 is connected to the first electrode of the storage capacitor C2 through the ninth switch S9. A second electrode of the storage capacitor C2 is grounded.

It will be noted that, the function of the first input circuit 221 is as described above, and the specific structure thereof may be determined according to actual needs, which is not limited in the embodiments of the present disclosure.

In some embodiments, with continued reference to FIG. 13, the first input circuit 221 includes a second operational amplifier A2, a sixth switch S6 and a seventh switch S7. A non-inverting input terminal of the second operational amplifier A2 is connected to the sensing circuit 223 through the sixth switch S6, and is further connected to a first voltage terminal U1 through the seventh switch S7; an inverting input terminal of the second operational amplifier A2 is connected to an output terminal thereof; and the output terminal of the second operational amplifier A2 is further connected to the first electrode of the driving transistor DT.

It will be noted that, the function of the second input circuit 222 is as described above, and the specific structure thereof may be determined according to actual needs, which is not limited in the embodiments of the present disclosure.

In some embodiments, with continued reference to FIG. 13, the second input circuit 222 includes a multiplexer MUX. The multiplexer MUX includes a first input terminal L1, a second input terminal L2 and an output terminal L0. The first input terminal L1 is connected to a second voltage terminal U2, and is configured to receive the second voltage transmitted by the second voltage terminal U2. The second input terminal L2 is connected to the controller 21, and is configured to receive the data voltage transmitted by the controller 21.

The output terminal L0 is connected to the control electrode of the driving transistor DT. The output terminal L0 is configured to: transmit the second voltage to the control electrode of the driving transistor DT in the initialization phase and the pre-storage phase; and transmit the data voltage to the control terminal of the driving transistor DT in the data compensation writing phase.

In some examples, with continued reference to FIG. 13, in the case where the light-emitting driving period further includes the aging sensing phase, the multiplexer MUX further includes a third input terminal L3. The third input terminal L3 is connected to a third voltage terminal U3, and is configured to receive the third voltage transmitted by the third voltage terminal U3.

The output terminal L0 of the multiplexer MUX is further configured to transmit the third voltage to the control electrode of the driving transistor DT in the aging sensing phase.

It can be easily understood that, the multiplexer MUX may achieve time-division transmissions of different data in response to corresponding control signals. For example, referring to FIG. 13, the multiplexer MUX is further connected to a first control signal line H1 and a second control signal line H2. The data transmission function of the multiplexer MUX is controlled by a first control signal transmitted by the first control signal line H1 and a second control signal together transmitted by the second control signal line H2. For example, in a case where the first control signal and the second control signal are both at low levels, the multiplexer MUX outputs the second voltage transmitted by the second voltage terminal U2. In a case where the first control signal is at a low level and the second control signal is at a high level, the multiplexer MUX outputs the data voltage transmitted by the controller 21. In a case where the first control signal and the second control signal are both at high levels, the multiplexer MUX outputs the third voltage transmitted by the third voltage terminal U3.

It can be seen from the above that, in some of the above examples, the controller 21 transmits the data voltage to the pixel driving circuit 101 through the multiplexer MUX. That is, the multiplexer MUX is used as the second input circuit 222 or a transmission signal line of the data voltage. In this way, the structure of the pixel compensation device 2 may be simplified, the space occupied by the corresponding signal line may be saved, which is conducive to achieving the narrow bezel design of the display apparatus 3.

In some examples, with continued reference to FIG. 13, the second input circuit 222 further includes a third operational amplifier A3. A non-inverting input terminal of the third operational amplifier A3 is connected to the output terminal L0 of the multiplexer MUX; an output terminal of the third operational amplifier A3 is connected to the control electrode of the driving transistor DT; and an inverting input terminal of the third operational amplifier A3 is connected to the output terminal of the third operational amplifier A3.

It can be easily understood that, the third operational amplifier A3 serves as a voltage follower in the second input circuit 222. In this way, by providing the voltage follower in the second input circuit 222, the pixel compensation device 2 may increase a signal driving capability of the second input circuit 222 (that is, the pixel compensation device 2 may reduce a loss of the data voltage during transmission), so as to effectively ensure an accuracy of the data voltage received by the pixel driving circuit 101 and even the display effect of the display apparatus 3.

In some examples, with continued reference to FIG. 13, the pixel compensation device 2 may further include an analog-to-digital converter ADC and/or a digital-to-analog converter DAC. The analog-to-digital converter ADC is connected between the sensing circuit 223 and the controller 21. The analog-to-digital converter ADC is configured to:

convert an analog signal (e.g., the first current, the second current, the third current, the threshold compensation voltage or the fourth voltage) output by the external compensation circuit 22 into a digital signal; and transmit the digital signal to the controller 21. The digital-to-analog converter DAC is connected between the controller 21 and the pixel driving circuit 101. The digital-to-analog converter DAC is configured to: convert a digital signal (corresponding to the data voltage) output by the controller 21 into an analog signal; and transmit the analog signal to the pixel driving circuit 101.

In order to describe the pixel compensation device 2 and the pixel compensation method in some embodiments of the present disclosure more clearly, the pixel compensation device 2 shown in FIG. 13 is taken as an example to describe in detail below.

It will be noted that, the internal structures of the pixel driving circuit 101, the sensing circuit 223, the first input circuit 221, the second input circuit 222 and the storage circuit 224 that are all shown in FIG. 13 have been described in detail in the foregoing embodiments, which will not be described in detail here. Only connection relationships between components of the pixel compensation device 2 and a connection relationship between the pixel compensation device 2 and the pixel driving circuit 101 will be described below.

As shown in FIG. 13, the second transistor T2 in the pixel driving circuit 101 is connected to the first switch S1 and the fourth switch S4 in the sensing circuit 223. The output terminal of the first operational amplifier A1 in the sensing circuit 223 is connected to the eighth switch S8 in the storage circuit 224 and the sixth switch S6 in the first input circuit 221. The ninth switch S9 in the storage circuit 224 is connected to an input terminal of the analog-to-digital converter ADC. An output terminal of the analog-to-digital converter ADC is connected to the controller 21. The controller 21 is further connected to an input terminal of the digital-to-analog converter DAC. An output terminal of the digital-to-analog converter DAC is connected to the second input terminal L2 of the multiplexer MUX in the second input circuit 222. The output terminal of the third operational amplifier A3 in the second input circuit 222 is connected to the second electrode of the first transistor T1 in the pixel driving circuit 101.

The method for compensating the pixel driving circuit 101 by the pixel compensation device 2 shown in FIG. 13 is as described below.

Figure 14:
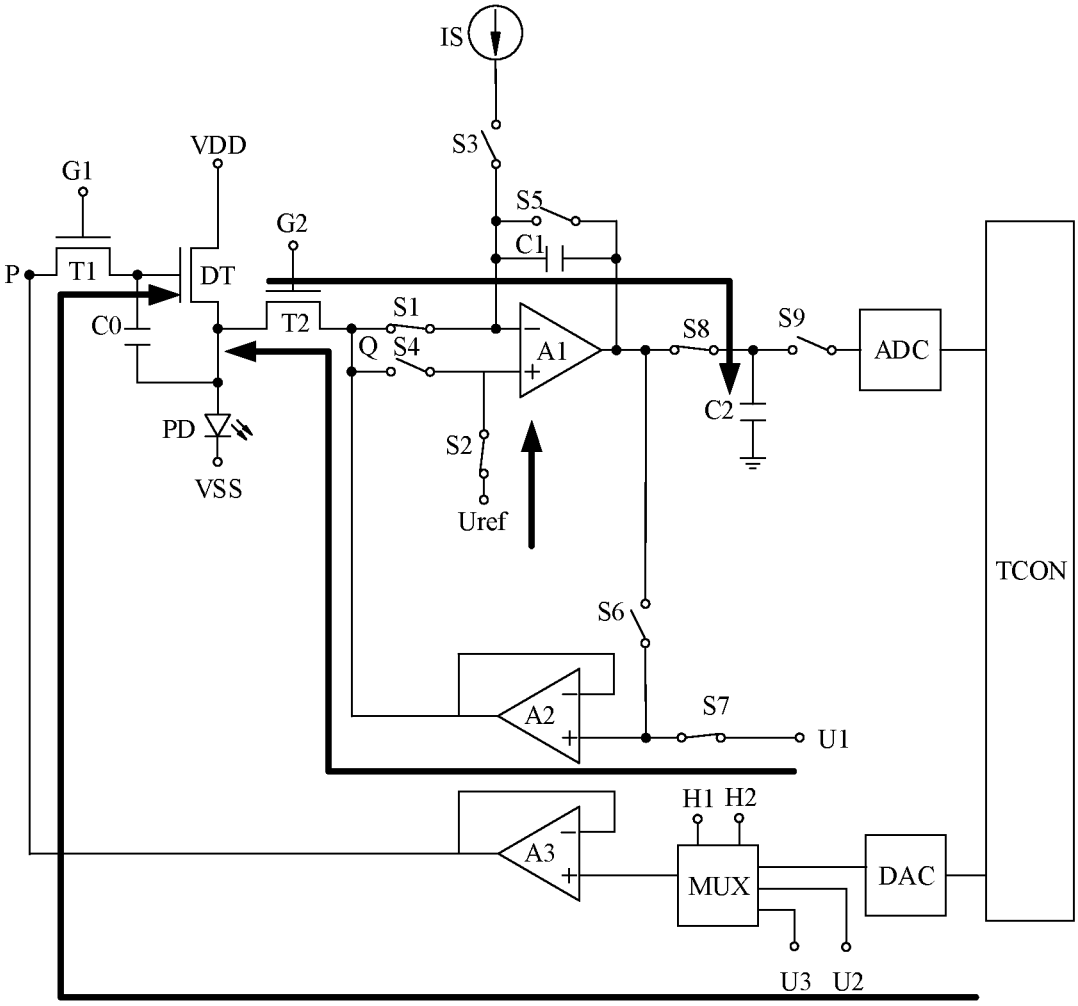
FIG. 14 is a schematic diagram showing signal transmission directions of the pixel compensation device shown in FIG. 13 in a first sub-phase of an initialization phase.
Figure 15:
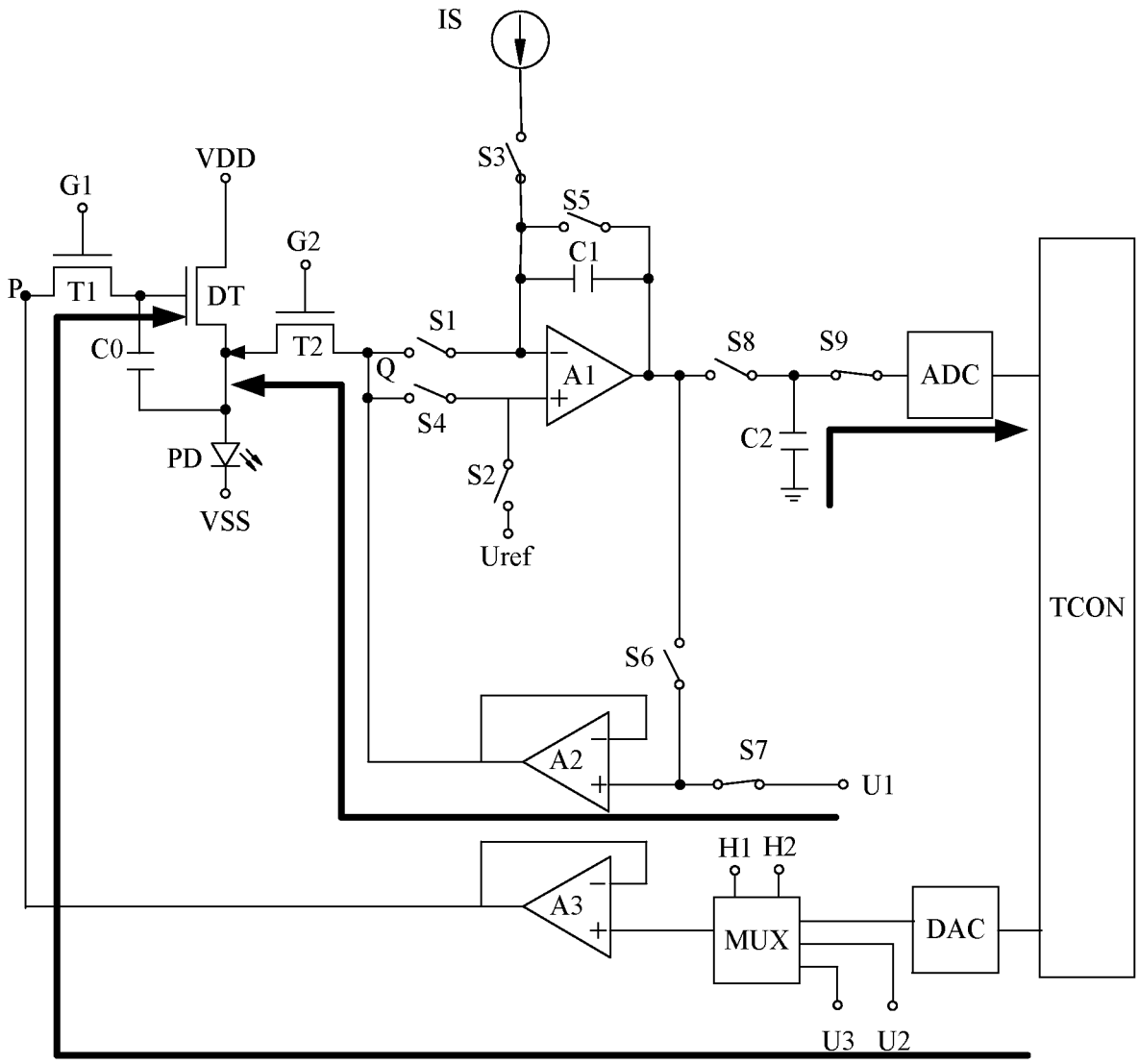
FIG. 15 is a schematic diagram showing signal transmission directions of the pixel compensation device shown in FIG. 13 in a second sub-phase of the initialization phase.

In the initialization phase (including the first sub-phase and the second sub-phase), referring to FIGS. 14 and 15, the first gate scanning signal controls the first transistor T1 to be turned on, the second gate scanning signal controls the second transistor T2 to be turned on, the sixth switch S6 is turned off, and the seventh switch S7 is turned on; the multiplexer MUX outputs the second voltage of the first input terminal in response to the first control signal and the second control signal, and transmits the second voltage to the control electrode of the driving transistor DT through the third operational amplifier A3 and the first transistor T1; the second operational amplifier A2 transmits the first voltage from the first voltage terminal U1 to the first electrode of the driving transistor DT through the second transistor T2, and the driving transistor DT outputs the first current.

Based on this, in the first sub-phase of the initialization phase, referring to FIG. 14, the first switch S1, the second switch S2 and the eighth switch S8 are all turned on, and the third switch S3, the fourth switch S4, the fifth switch S5 and the ninth switch S9 are all turned off; the first current is transmitted to the inverting input terminal of the first operational amplifier A1 through the second transistor T2 and the first switch S1; the reference voltage from the reference voltage terminal Uref is transmitted to the non-inverting input terminal of the first operational amplifier A1 through the second switch S2; an integrator constituted by the integrating capacitor C1 and the first operational amplifier A1 outputs a first signal according to the first current and the reference voltage, the first signal including a first current signal; the first signal is transmitted to the first electrode of the storage capacitor C2 through the eighth switch S8; and the storage capacitor C2 is charged to store the first signal.

In the second sub-phase of the initialization phase, referring to FIG. 15, the first switch S1, the second switch S2, the third switch S3, the fourth switch S4, the fifth switch S5 and the eighth switch S8 are all turned off, and the ninth switch S9 is turned on; the storage capacitor C2 is discharged to transmit the first signal to the controller 21 through the ninth switch S9 and the analog-to-digital converter ADC.

Figure 16:
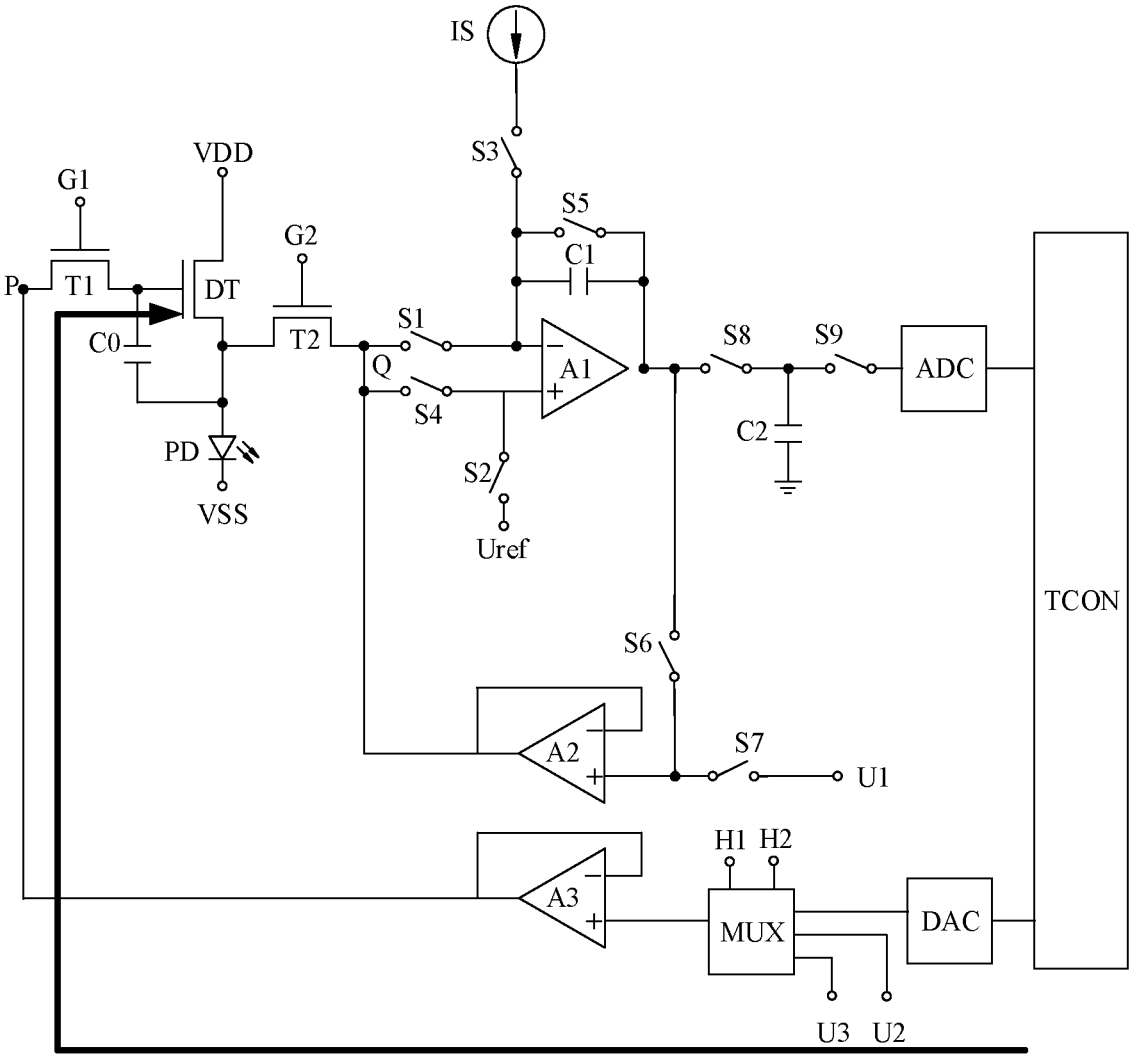
FIG. 16 is a schematic diagram showing a signal transmission direction of the pixel compensation device shown in FIG. 13 in a pre-storage phase.

In the pre-storage phase, referring to FIG. 16, the first gate scanning signal controls the first transistor T1 to be turned on, and the second gate scanning signal controls the second transistor T2 to be turned on; the first switch S1, the second switch S2, the third switch S3, the fourth switch S4, the fifth switch S5, the sixth switch S6, the seventh switch S7, the eighth switch S8 and the ninth switch S9 are all turned off; the multiplexer MUX outputs the second voltage of the first input terminal in response to the first control signal and the second control signal, and the second voltage is continuously transmitted to the control electrode of the driving transistor DT through the third operational amplifier A3 and the first transistor T1; the non-inverting input terminal of the second operational amplifier A2 floats; the voltage of the first electrode of the driving transistor DT changes from the first voltage to the threshold compensation voltage, and the threshold compensation voltage is written into the second electrode of the first capacitor C0.

Figure 17:
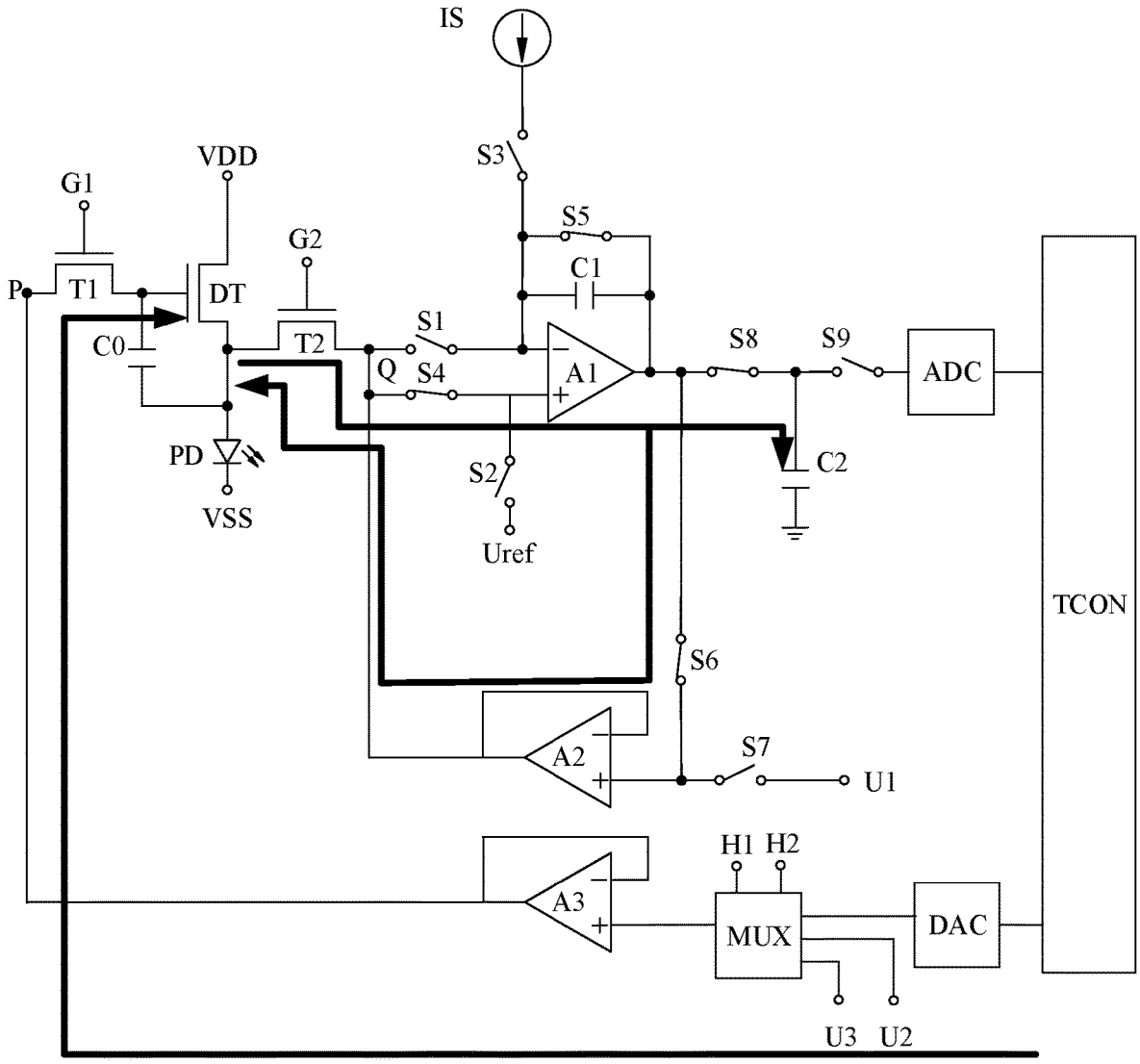
FIG. 17 is a schematic diagram showing signal transmission directions of the pixel compensation device shown in FIG. 13 in a first sub-phase of a data compensation writing phase.
Figure 18:
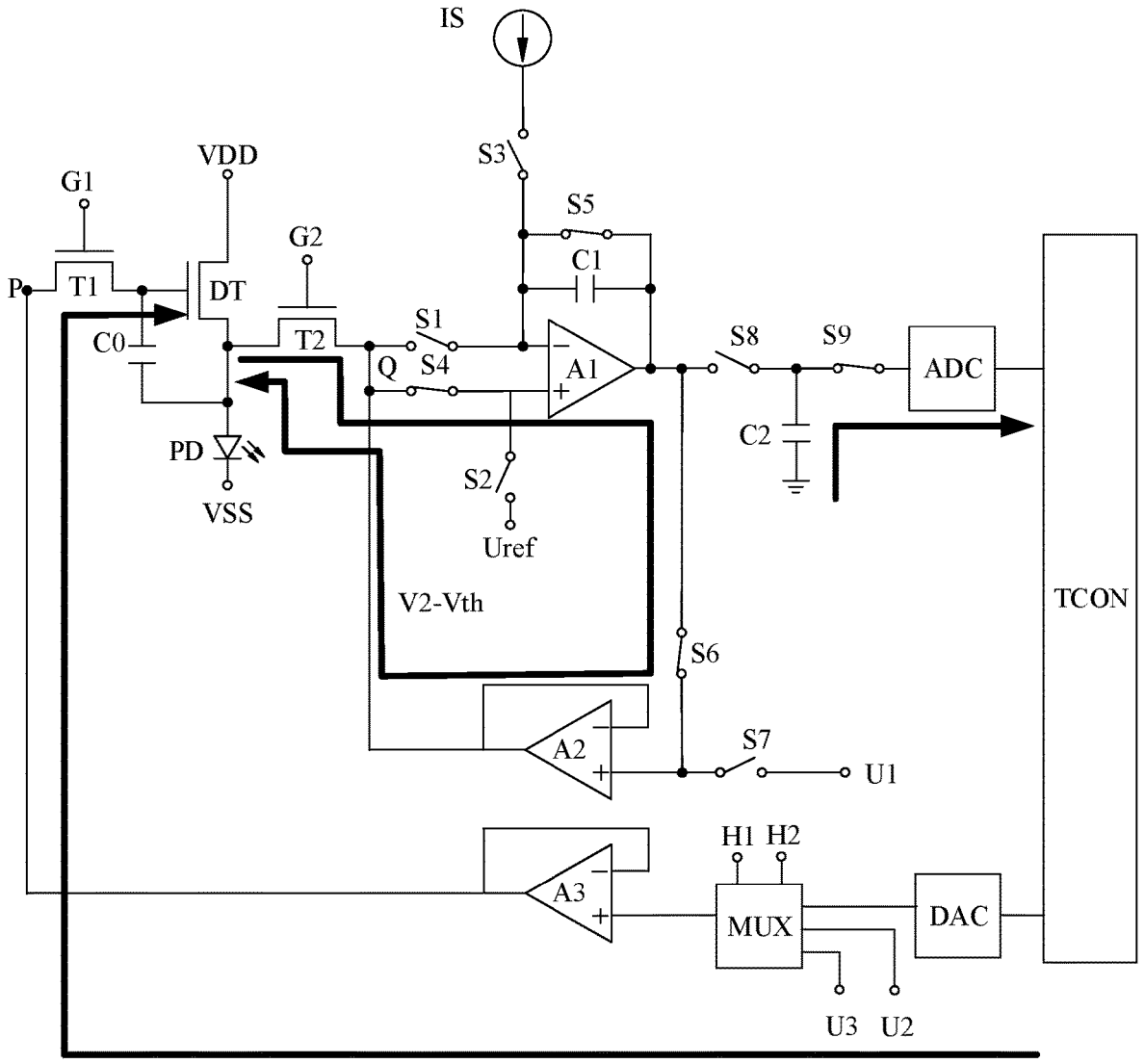
FIG. 18 is a schematic diagram showing signal transmission directions of the pixel compensation device shown in FIG. 13 in a second sub-phase of the data compensation writing phase.

In the data compensation writing phase (including the first sub-phase and the second sub-phase), referring to FIGS. 17 and 18, the first gate scanning signal controls the first transistor T1 to be turned on, and the second gate scanning signal controls the second transistor T2 to be turned on; the first switch S1, the second switch S2, the third switch S3 and the seventh switch S7 are all turned off; the fourth switch S4, the fifth switch S5 and the sixth switch S6 are all turned on; and the multiplexer MUX outputs the data voltage of the second input terminal in response to the first control signal and the second control signal.

The controller 21 transmits the data voltage to the second input terminal of the multiplexer MUX through the digital-to-analog converter DAC; the multiplexer MUX transmits the data voltage to the control electrode of the driving transistor DT through the third operational amplifier A3 and the first transistor T1. The threshold compensation voltage at the first electrode of the driving transistor DT is transmitted to the non-inverting input terminal of the first operational amplifier A1 through the second transistor T2 and the fourth switch S4, and then the threshold compensation voltage is output by an output terminal of a voltage follower constituted by the first operational amplifier A1 and the fifth switch S5; after that, the threshold compensation voltage is fed back to the first electrode of the driving transistor DT through the sixth switch S6, the second operational amplifier A2 and the second transistor T2.

On this basis, in the first sub-phase of the data compensation writing phase, referring to FIG. 17, the eighth switch S8 is turned on, and the ninth switch S9 is turned off; the threshold compensation voltage output by the output terminal of the voltage follower constituted by the first operational amplifier A1 and the fifth switch S5 is further transmitted to the first electrode of the storage capacitor C2 through the eighth switch S8; and the storage capacitor C2 is charged to store the threshold compensation voltage.

In the second sub-phase of the data compensation writing phase, referring to FIG. 18, the eighth switch S8 is turned off, and the ninth switch S9 is turned on; the storage capacitor C2 is discharged to transmit the threshold compensation voltage to the controller 21 through the ninth switch S9 and the analog-to-digital converter ADC, and the controller 21 determines the actual characteristic value of the driving transistor DT according to the first signal and the threshold compensation voltage.

Figure 19:
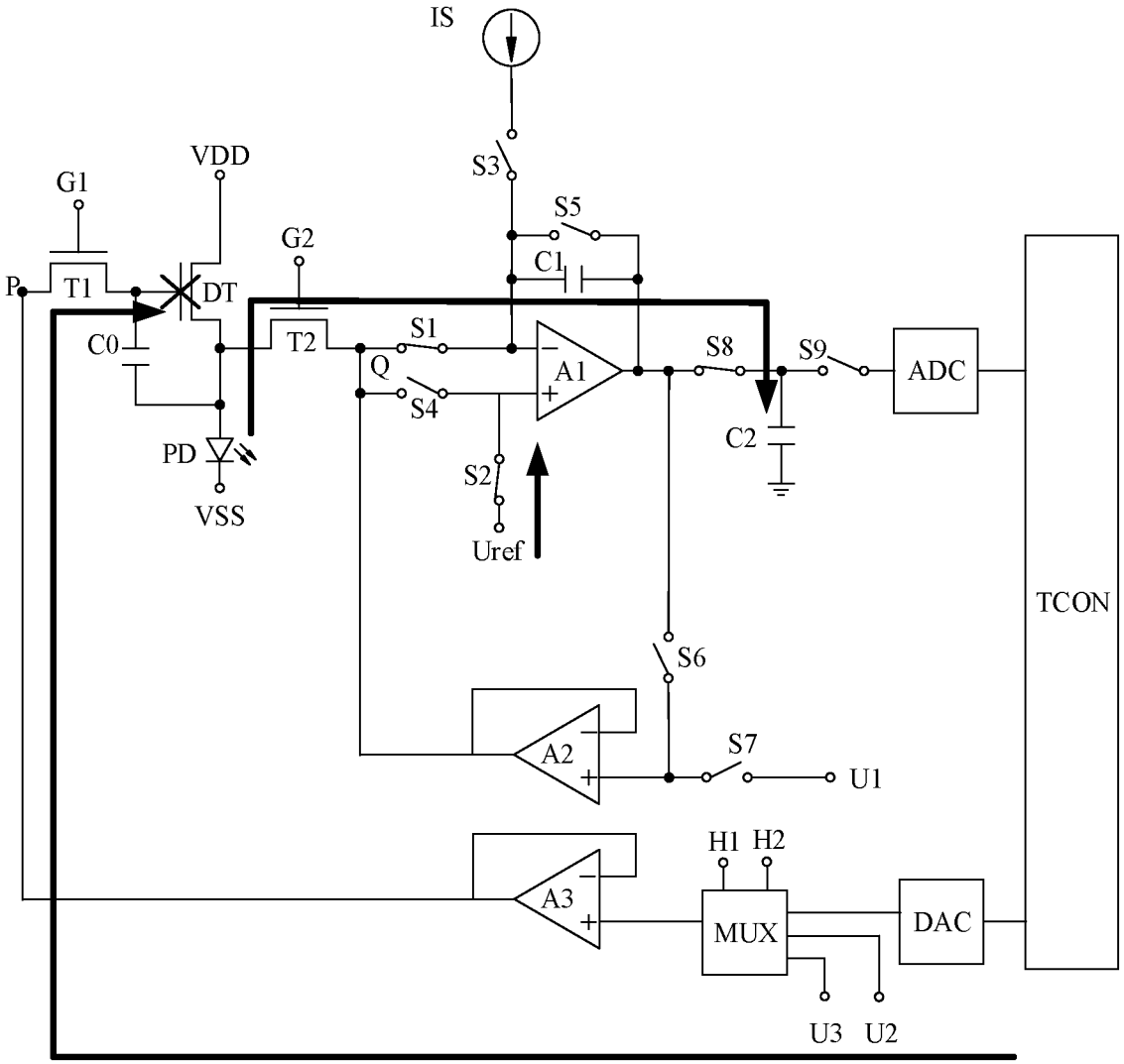
FIG. 19 is a schematic diagram showing signal transmission directions of the pixel compensation device shown in FIG. 13 in a first sub-phase of an aging sensing phase.
Figure 20:
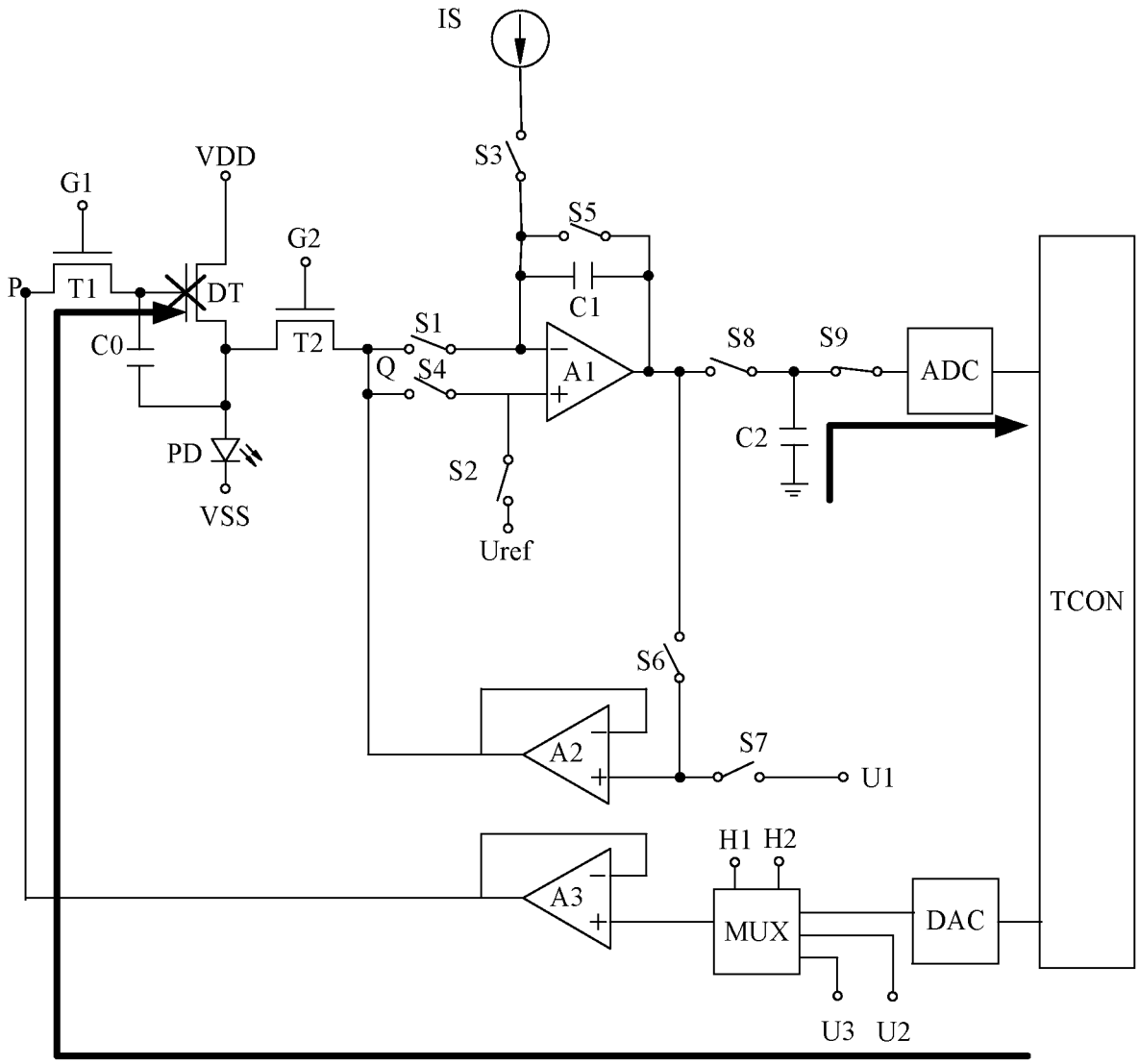
FIG. 20 is a schematic diagram showing signal transmission directions of the pixel compensation device shown in FIG. 13 in a second sub-phase of the aging sensing phase.

In the aging sensing phase (including the first sub-phase and the second sub-phase), referring to FIGS. 19 and 20, the first gate scanning signal controls the first transistor T1 to be turned on, and the second gate scanning signal controls the second transistor T2 to be turned on; the multiplexer MUX outputs the third voltage of the third input terminal in response to the first control signal and the second control signal, and transmits the third voltage to the control electrode of the driving transistor DT through the third operational amplifier A3 and the first transistor T1, so as to control the driving transistor DT to be turned off; the third switch S3, the fourth switch S4, the fifth switch S5, the sixth switch S6 and the seventh switch S7 are all turned off; and the light-emitting device PD is discharged and outputs the second current.

It will be noted that, in the first sub-phase of the aging sensing phase, referring to FIG. 19, the first switch S1, the second switch S2 and the eighth switch S8 are all turned on, and the ninth switch S9 is turned off; the second current output by the light-emitting device PD is transmitted to the inverting input terminal of the first operational amplifier A1 through the second transistor T2 and the first switch S1; the reference voltage from the reference voltage terminal Uref is transmitted to the non-inverting input terminal of the first operational amplifier A1 through the second switch S2; the integrator constituted by the integrating capacitor C1 and the first operational amplifier A1 outputs a second signal according to the second current and the reference voltage, the second signal including a second current signal; the second signal is transmitted to the first electrode of the storage capacitor C2 through the eighth switch S8; and the storage capacitor C2 is charged to store the second signal.

In the second sub-phase of the aging sensing phase, referring to FIG. 20, the first switch S1, the second switch S2 and the eighth switch S8 are all turned off, and the ninth switch S9 is turned on; the second signal stored in the storage capacitor C2 is transmitted to the controller 21 through the ninth switch S9 and the analogue-to-digital converter ADC, and the controller 21 determines the aging information of the light-emitting device PD according to the second signal.

Figure 21:
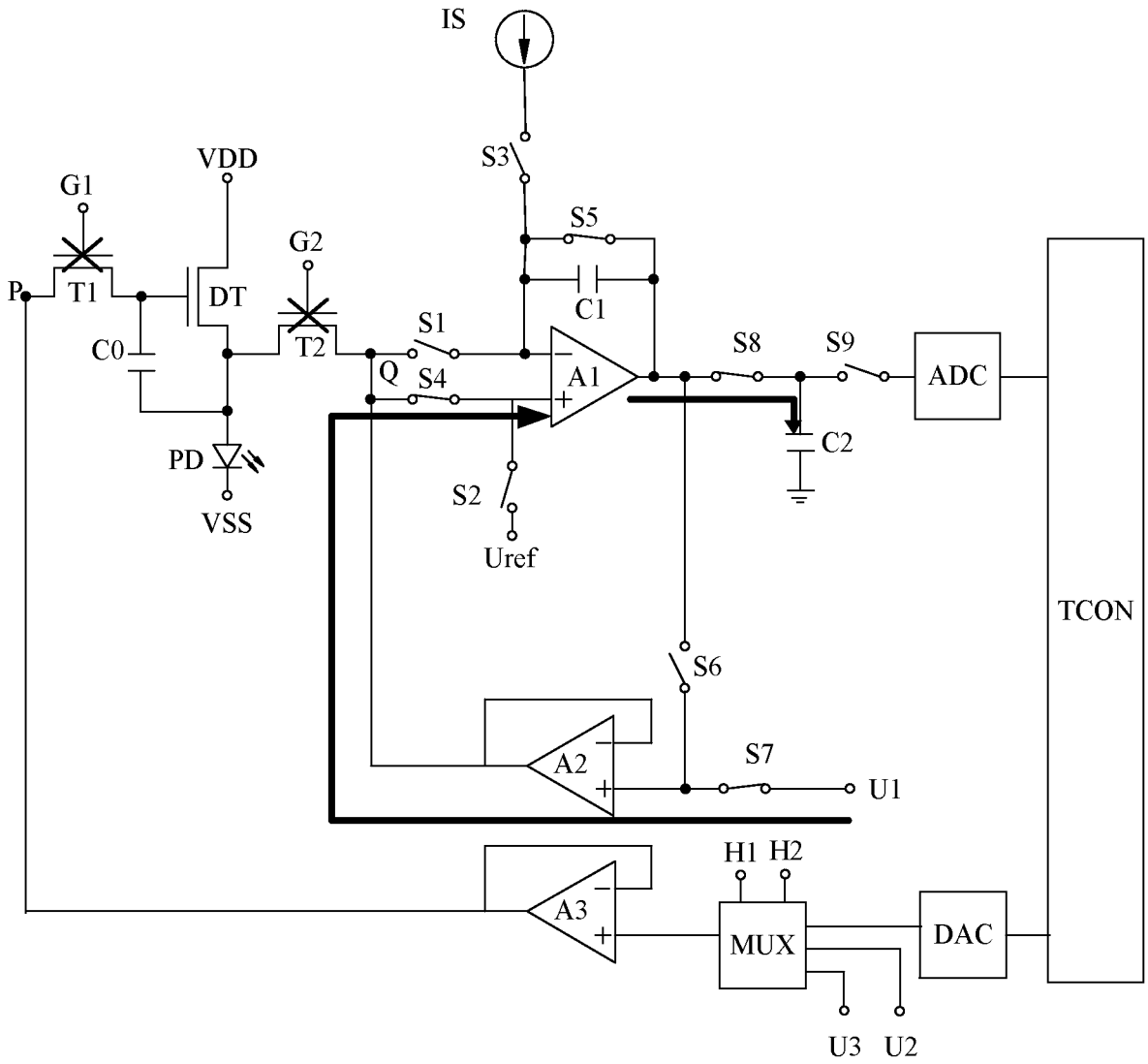
FIG. 21 is a schematic diagram showing signal transmission directions of the pixel compensation device shown in FIG. 13 in a first sub-phase of a first calibration phase.

In the first sub-phase of the first calibration phase, referring to FIG. 21, the first gate scanning signal controls the first transistor T1 to be turned off, and the second gate scanning signal controls the second transistor T2 to be turned off; the fourth switch S4, the fifth switch S5, the seventh switch S7 and the eighth switch S8 are all turned on, and the first switch S1, the second switch S2, the third switch S3, the sixth switch S6 and the ninth switch S9 are all turned off; the first voltage from the first voltage terminal U1 is transmitted to the non-inverting input terminal of the first operational amplifier A1 through the second operational amplifier A2 and the fourth switch S4; the voltage follower constituted by the first operational amplifier A1 and the fifth switch S5 outputs the fourth voltage, and the fourth voltage is transmitted to the first electrode of the storage capacitor C2 through the eighth switch S8; and the storage capacitor C2 is charged to store the fourth voltage.

Figure 22:
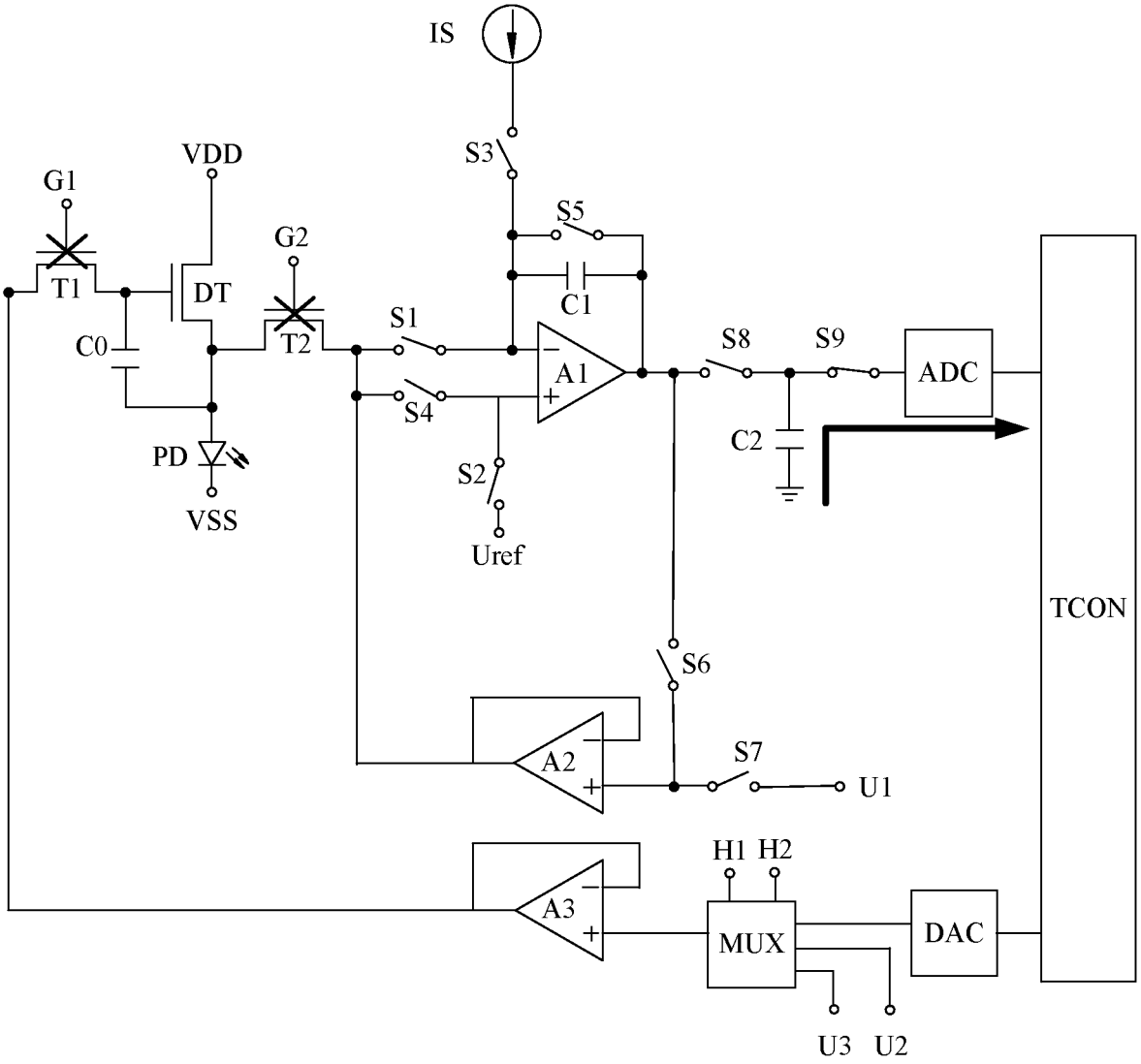
FIG. 22 is a schematic diagram showing a signal transmission direction of the pixel compensation device shown in FIG. 13 in a second sub-phase of the first calibration phase.

In the second sub-phase of the first calibration phase, referring to FIG. 22, the first gate scanning signal controls the first transistor T1 to be turned off, and the second gate scanning signal controls the second transistor T2 to be turned off; the first switch S1, the second switch S2, the third switch S3, the fourth switch S4, the fifth switch S5, the sixth switch S6, the seventh switch S7 and the eighth switch S8 are all turned off, and the ninth switch S9 is turned on; the storage capacitor C2 is discharged to transmit the fourth voltage to the controller 21 through the ninth switch S9 and the analogue-to-digital converter ADC; the controller 21 corrects the sensing voltage signal transmitted from the voltage sensing sub-circuit 2232 to the controller 21 according to the difference between the fourth voltage and the first voltage.

Figure 23:
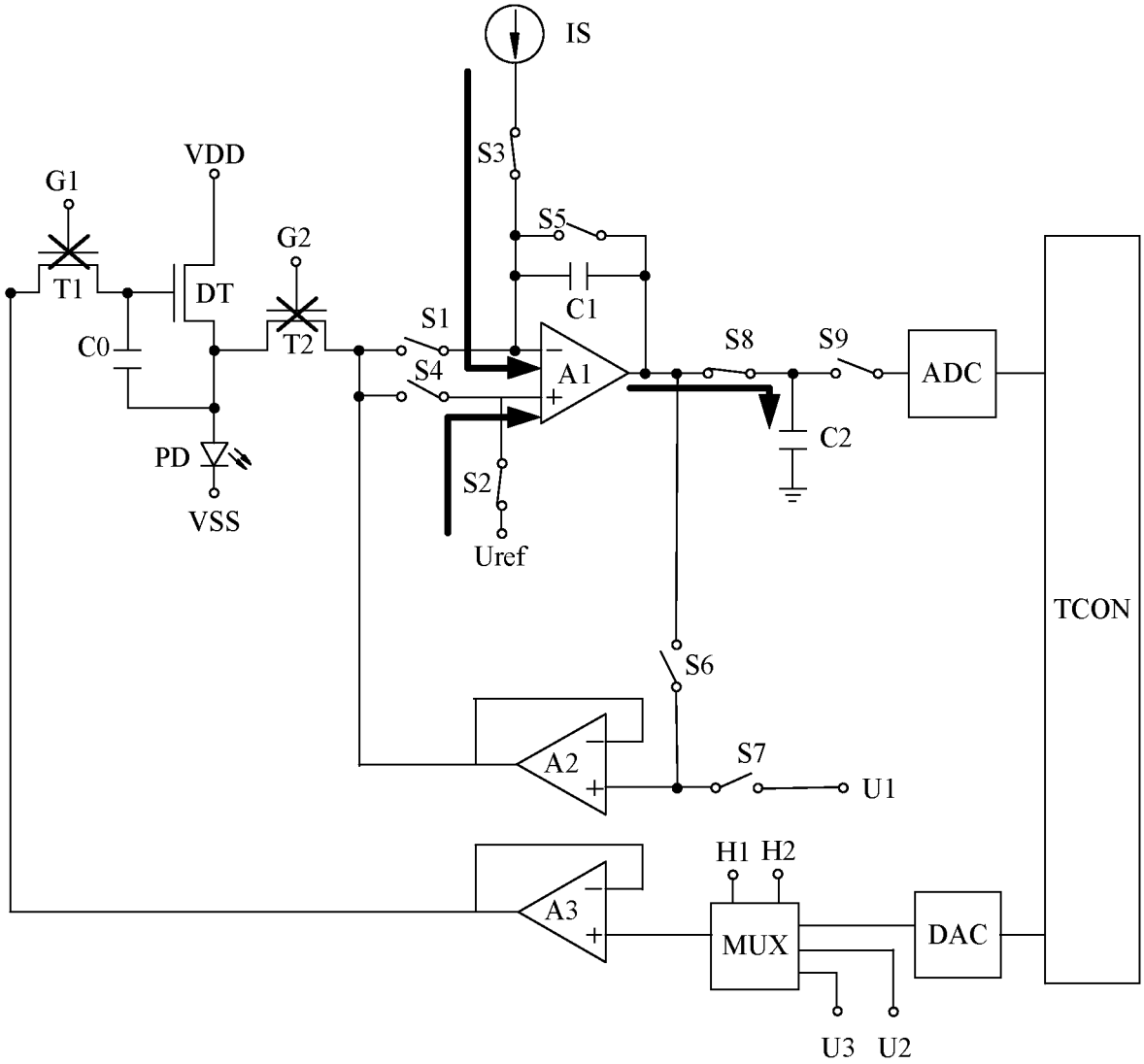
FIG. 23 is a schematic diagram showing signal transmission directions of the pixel compensation device shown in FIG. 13 in a first sub-phase of a second calibration phase.

In the first sub-phase of the second calibration phase, referring to FIG. 23, the first gate scanning signal controls the first transistor T1 to be turned off, and the second gate scanning signal controls the second transistor T2 to be turned off; the second switch S2, the third switch S3 and the eighth switch S8 are all turned on, and the first switch S1, the fourth switch S4, the fifth switch S5, the sixth switch S6, the seventh switch S7 and the ninth switch S9 are all turned off; the reference voltage from the reference voltage terminal Uref is transmitted to the non-inverting input terminal of the first operational amplifier A1 through the second switch S2; the reference current from the reference current source IS is transmitted to the inverting input terminal of the first operational amplifier A1 through the third switch S3; the integrator constituted by the first operational amplifier A1 and the integrating capacitor 01 outputs a third signal, the third signal including a third current signal; the third signal is transmitted to the first electrode of the storage capacitor C2 through the eighth switch S8; and the storage capacitor C2 is charged to store the third signal.

Figure 24:
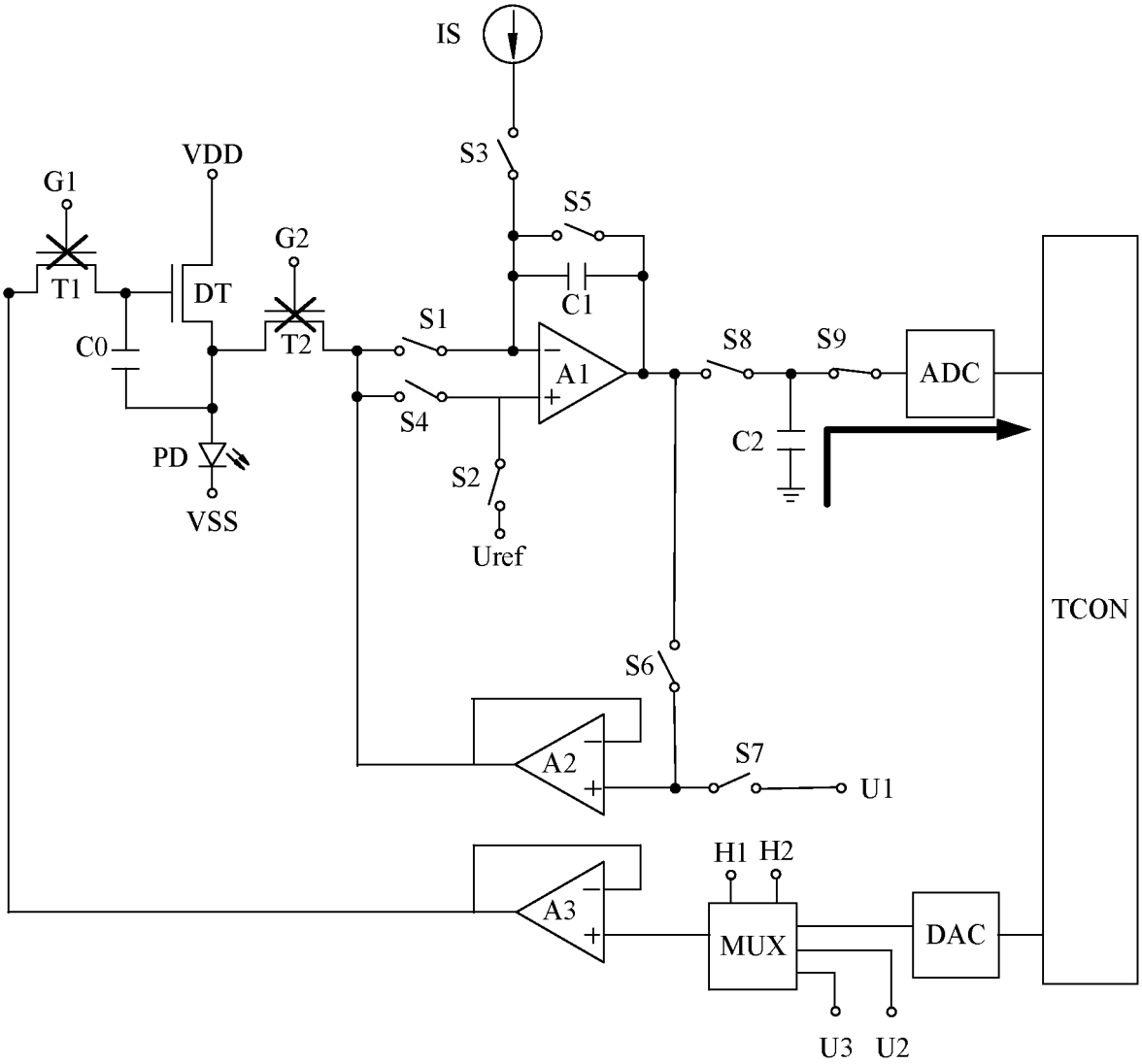
FIG. 24 is a schematic diagram showing a signal transmission direction of the pixel compensation device shown in FIG. 13 in a second sub-phase of the second calibration phase.

In the second sub-phase of the second calibration phase, referring to FIG. 24, the first gate scanning signal controls the first transistor T1 to be turned off, and the second gate scanning signal controls the second transistor T2 to be turned off; the first switch S1, the second switch S2, the third switch S3, the fourth switch S4, the fifth switch S5, the sixth switch S6, the seventh switch S7 and the eighth switch S8 are all turned off, and the ninth switch S9 is turned on; the storage capacitor C2 is discharged to transmit the third current signal to the controller 21 through the ninth switch S9 and the analogue-to-digital converter ADC; and the controller 21 corrects the sensing current signal transmitted by the current sensing sub-circuit 2231 to the controller 21 according to the difference between the third current signal and the reference current.

It can be seen from the above that, in the pixel compensation device 2 shown in FIG. 13, the integrator constituted by the first operational amplifier A1 and the integrating capacitor C1 are used for sensing and outputting the current signals (including the first current signal and the second current signal). By connecting the inverting input terminal of the first operational amplifier A1 to the output terminal of the first operational amplifier A1, the first operational amplifier A1 serves as the voltage follower to sense and output the sensing voltage signal (including the threshold compensation voltage). That is, in some embodiments of the present disclosure, the pixel compensation device 2 achieves two functions of voltage sensing and current sensing by using the first operational amplifier A1. In this way, the circuit structure of the pixel compensation device 2 may be simplified, the space occupied by a corresponding electronic device may be saved, which is conducive to achieving the narrow bezel design of the display apparatus 3.

Figure 25:
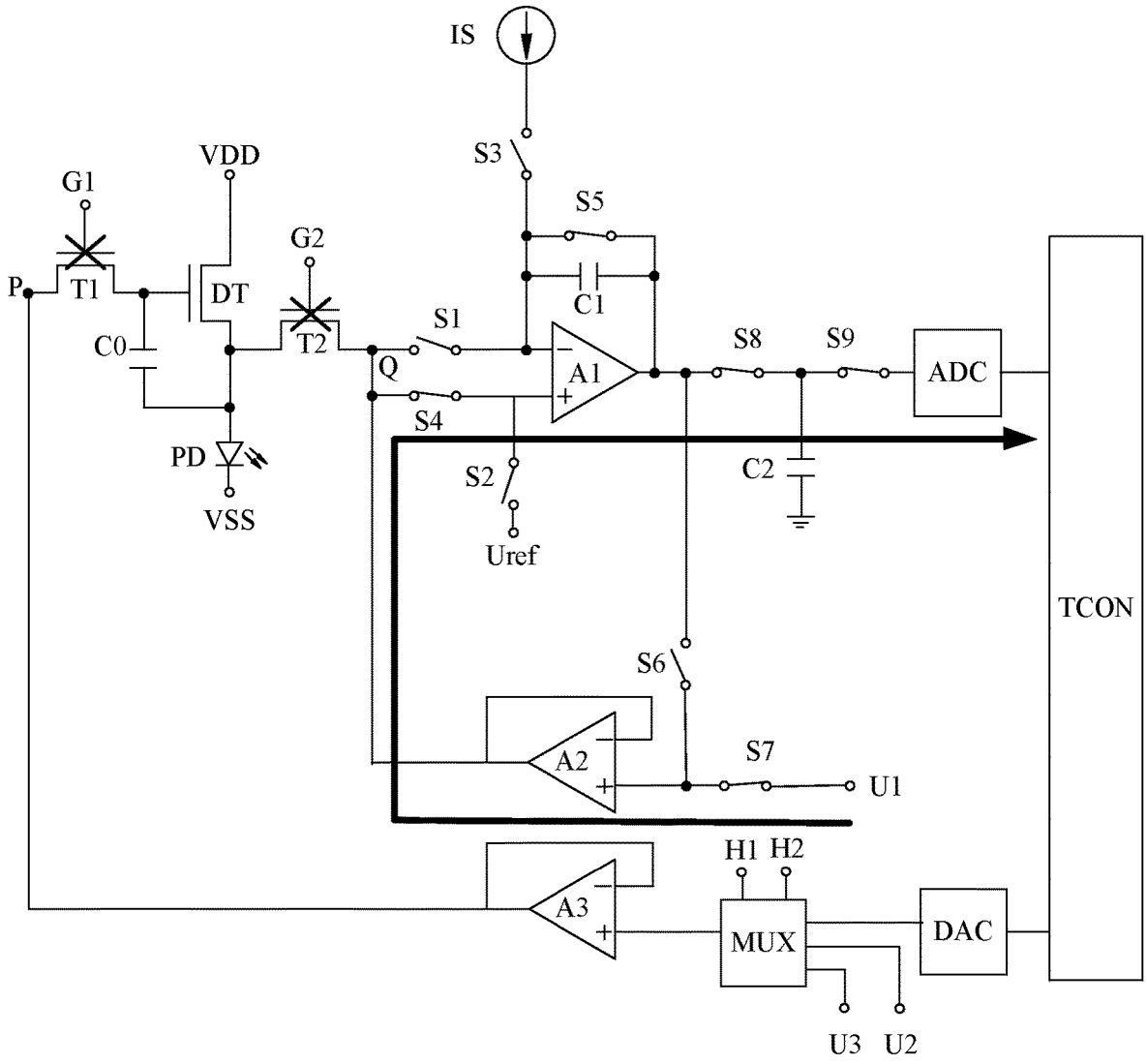
FIG. 25 is a schematic diagram showing a signal transmission direction of the pixel compensation device shown in FIG. 13 in a calibration phase of an analog-to-digital converter.

In some embodiments, the analog-to-digital converter ADC may be calibrated by using the first voltage terminal U1 before calibration of the sensing circuit 223. For example, referring to FIG. 25, in a calibration phase of the analog-to-digital converter ADC, the first gate scanning signal controls the first transistor T1 to be turned off, and the second gate scanning signal controls the second transistor T2 to be turned off; the first switch S1, the second switch S2, the third switch S3 and the sixth switch S6 are all turned off, and the fourth switch S4, the fifth switch S5, the seventh switch S7, the eighth switch S8 and the ninth switch S9 are all turned on; the first voltage from the first voltage terminal U1 is transmitted to the non-inverting input terminal of the first operational amplifier A1 through the second operational amplifierA2 and the fourth switch S4; the voltage follower constituted by the first operational amplifier A1 and the fifth switch S5 outputs the first voltage, and the first voltage is transmitted to the analog-to-digital converter ADC through the eighth switch S8 and the ninth switch S9; and the analog-to-digital converter ADC outputs a fifth voltage to the controller 21. In this way, the controller 21 may correct the sensing signals (including the sensing current signal and the sensing voltage signal) transmitted by the sensing circuit 223 to the controller 21 according to a difference between the fifth voltage and the first voltage, so as to further ensure the accuracies of the sensing signals and make the compensation of the sub-pixel PX performed by the pixel compensation device 2 more accurate.

It will be noted that, in some embodiments of the present disclosure, the first switch S1, the second switch S2, the third switch S3, the fourth switch S4, the fifth switch S5, the sixth switch S6, the seventh switch S7, the eighth switch S8 or the ninth switch S9 may be any electronic device that can be turned on and turned off by a control signal. For example, the first switch S1, the second switch S2, the third switch S3, the fourth switch S4, the fifth switch S5, the sixth switch S6, the seventh switch S7, the eighth switch S8 or the ninth switch S9 is a switching transistor. The switching transistor is a P-type transistor or an N-type transistor, which is controlled to be turned on or turned off by a corresponding control signal applied to a control electrode thereof. For example, the control signal is provided by the controller 21 (e.g., the TCON).

Beneficial effects that may be achieved by the display apparatus 3 and the pixel compensation method provided in some embodiments of the present disclosure are the same as beneficial effects of the pixel compensation device 2 in the above embodiments of the present disclosure, which will not be described in detail here.

In the description of the above embodiments, the specific features, structures, materials or characteristics may be combined in any one or more embodiments or to examples in any suitable manner.

The foregoing descriptions are merely specific implementations of the present disclosure, but the protection scope of the present disclosure is not limited thereto. Changes or replacements that any person skilled in the art could conceive of within the technical scope of the present disclosure shall be included in the protection scope of the present disclosure. Therefore, the protection scope of the present disclosure shall be subject to the protection scope of the claims.

What is claimed is:

1. A pixel compensation device, comprising:

a controller; and at least one external compensation circuit connected to the controller; wherein an external compensation circuit is configured to be connected to at least one pixel driving circuit; the pixel driving circuit includes a driving sub-circuit, and a first terminal of the driving sub-circuit is configured to be connected to a light-emitting device; and a light-emitting driving period of the pixel driving circuit includes an initialization phase, a pre-storage phase and a data compensation writing phase;

wherein the external compensation circuit includes a first input circuit, a second input circuit and a sensing circuit;

the first input circuit is connected to the sensing circuit; the first input circuit is configured to be further connected to the first terminal of the driving sub-circuit; and the first input circuit is further configured to: transmit a first voltage to the first terminal of the driving sub-circuit in the initialization phase; perform blanking in the pre-storage phase; and transmit a threshold compensation voltage to the first terminal of the driving sub-circuit in the data compensation writing phase;

the second input circuit is configured to be connected to a control terminal of the driving sub-circuit; the second input circuit is further configured to transmit a second voltage to the control terminal of the driving sub-circuit in the initialization phase and the pre-storage phase, so that a voltage of the first terminal of the driving sub-circuit changes from the first voltage to the threshold compensation voltage in the pre-storage phase; wherein the first voltage and the threshold compensation voltage are both less than a turn-on voltage of the light-emitting device, and the threshold compensation voltage is equal to a difference between the second voltage and a threshold voltage of the driving sub-circuit;

the sensing circuit is configured to be further connected to the first terminal of the driving sub-circuit, and the sensing circuit is further configured to: sense the threshold compensation voltage in the data compensation writing phase; and transmit the threshold compensation voltage to the first input circuit;

the controller is configured to be further connected to the control terminal of the driving sub-circuit, and the controller is further configured to transmit a data voltage to the control terminal of the driving sub-circuit in the data compensation writing phase.

2. The pixel compensation device according to claim 1, wherein the sensing circuit is further connected to the controller, and the sensing circuit is further configured to: sense a first current transmitted by the first terminal of the driving sub-circuit and transmit the first current to the controller in the initialization phase; and transmit the sensed threshold compensation voltage to the controller in the data compensation writing phase;

the controller is further configured to: determine an actual characteristic value of the driving sub-circuit according to the first current and the threshold compensation voltage; and correct a data voltage to be transmitted in a next data compensation writing phases according to the actual characteristic value.

3. The pixel compensation device according to claim 1, wherein the light-emitting driving period further includes an aging sensing phase;

the second input circuit is further configured to transmit a third voltage to the control terminal of the driving sub-circuit in the aging sensing phase, so as to control the driving sub-circuit to be turned off;

the sensing circuit is further configured to sense a second current transmitted from the light-emitting device to the first terminal of the driving sub-circuit in the aging sensing phase, and transmit the second current to the controller;

the controller is further configured to: determine aging information of the light-emitting device according to the second current; and correct a data voltage to be transmitted in a next data compensation writing phase according to the aging information.

4. The pixel compensation device according to claim 3, wherein the sensing circuit includes a current sensing sub-circuit, and the current sensing sub-circuit is connected to the first terminal of the driving sub-circuit and the controller; the current sensing sub-circuit is configured to: sense a first current at the first terminal of the driving sub-circuit and transmit the first current to the controller in the initialization phase; and/or sense the second current at the first terminal of the driving sub-circuit and transmit the second current to the controller in the aging sensing phase; or the sensing circuit includes the current sensing sub-circuit, and the current sensing sub-circuit is connected to the first terminal of the driving sub-circuit and the controller; the current sensing sub-circuit is configured to: sense the first current at the first terminal of the driving sub-circuit and transmit the first current to the controller in the initialization phase; and/or sense the second current at the first terminal of the driving sub-circuit and transmit the second current to the controller in the aging sensing phase; wherein the light-emitting driving period further includes a second calibration phase;

the current sensing sub-circuit is further connected to a reference current source;

the reference current source is configured to transmit a reference current to the current sensing sub-circuit in the second calibration phase, so that the current sensing sub-circuit outputs a third current; and the controller is further configured to correct at least one sensing current signal transmitted by the current sensing sub-circuit to the controller according to a difference between the third current and the reference current; the at least one sensing current signal incudes the first current and/or the second current.

5. The pixel compensation device according to claim 4, wherein the current sensing sub-circuit includes a first operational amplifier, an integrating capacitor, a first switch and a second switch; wherein a non-inverting input terminal of the first operational amplifier is connected to a reference voltage terminal through the second switch;

an inverting input terminal of the first operational amplifier is connected to the first terminal of the driving sub-circuit through the first switch; the inverting input terminal of the first operational amplifier is further connected to a first electrode of the integrating capacitor; and an output terminal of the first operational amplifier is connected to a second electrode of the integrating capacitor and the controller.

6. The pixel compensation device according to claim 1, wherein the sensing circuit includes a voltage sensing sub-circuit, and the voltage sensing sub-circuit is connected to the first terminal of the driving sub-circuit and the first input circuit; the voltage sensing sub-circuit is configured to, in the data compensation writing phase, sense the threshold compensation voltage at the first terminal of the driving sub-circuit and transmit the threshold compensation voltage to the first input circuit; or the sensing circuit includes the voltage sensing sub-circuit, and the voltage sensing sub-circuit is connected to the first terminal of the driving sub-circuit and the first input circuit; the voltage sensing sub-circuit is configured to, in the data compensation writing phase, sense the threshold compensation voltage at the first terminal of the driving sub-circuit and transmit the threshold compensation voltage to the first input circuit; wherein the voltage sensing sub-circuit is further connected to the controller; and the voltage sensing sub-circuit is further configured to transmit the sensed threshold compensation voltage to the controller in the data compensation writing phase.

7. The pixel compensation device according to claim 6, wherein the light-emitting driving period further includes a first calibration phase;

the first input circuit is further configured to transmit the first voltage to the voltage sensing sub-circuit in the first calibration phase, so that the voltage sensing sub-circuit outputs a fourth voltage to the controller; and the controller is further configured to correct a sensing voltage signal transmitted from the voltage sensing sub-circuit to the controller according to a difference between the fourth voltage and the first voltage; the sensing voltage signal including the threshold compensation voltage.

8. The pixel compensation device according to claim 6, wherein the voltage sensing sub-circuit includes a first operational amplifier, a fourth switch and a fifth switch;

a non-inverting input terminal of the first operational amplifier is connected to the first terminal of the driving sub-circuit through the fourth switch;

an inverting input terminal of the first operational amplifier is connected to an output terminal of the first operational amplifier through the fifth switch.

9. The pixel compensation device according to claim 1, wherein the second input circuit includes a multiplexer; the multiplexer includes a first input terminal, a second input terminal and an output terminal; the first input terminal is connected to a second voltage terminal, and is configured to receive the second voltage transmitted by the second voltage terminal; the second input terminal is connected to the controller, and is configured to receive the data voltage transmitted by the controller; the output terminal of the multiplexer is connected to the control terminal of the driving sub-circuit, and is configured to: transmit the second voltage to the control terminal of the driving sub-circuit in the initialization phase and the pre-storage phase; and transmit the data voltage to the control terminal of the driving sub-circuit in the data compensation writing phase; or the second input circuit includes the multiplexer; the multiplexer includes the first input terminal, the second input terminal and the output terminal; the first input terminal is connected to the second voltage terminal, and is configured to receive the second voltage transmitted by the second voltage terminal; the second input terminal is connected to the controller, and is configured to receive the data voltage transmitted by the controller; the output terminal of the multiplexer is connected to the control terminal of the driving sub-circuit, and is configured to: transmit the second voltage to the control terminal of the driving sub-circuit in the initializing phase and the pre-storage phase; and transmit the data voltage to the control terminal of the driving sub-circuit in the data compensation writing phase; wherein the light-emitting driving period further includes an aging sensing phase, and the multiplexer further includes a third input terminal;

the third input terminal is connected to a third voltage terminal, and is configured to receive a third voltage transmitted by the third voltage terminal;

the output terminal of the multiplexer is further configured to transmit the third voltage to the control terminal of the driving sub-circuit in the aging sensing phase.

10. The pixel compensation device according to claim 9, wherein the second input circuit further includes a third operational amplifier;

a non-inverting input terminal of the third operational amplifier is connected to the output terminal of the multiplexer;

an output terminal of the third operational amplifier is connected to the control terminal of the driving sub-circuit;

an inverting input terminal of the third operational amplifier is connected to the output terminal of the third operational amplifier.

11. The pixel compensation device according to claim 1, wherein the first input circuit includes a second operational amplifier, a sixth switch and a seventh switch;

a non-inverting input terminal of the second operational amplifier is connected to the sensing circuit through the sixth switch, and is further connected to a first voltage terminal through the seventh switch;

an inverting input terminal of the second operational amplifier is connected to an output terminal of the second operational amplifier;

the output terminal of the second operational amplifier is further connected to the first terminal of the driving sub-circuit.

12. The pixel compensation device according to claim 1, wherein the external compensation circuit further includes a storage circuit, and the storage circuit is connected between the sensing circuit and the controller; the storage circuit is configured to store at least one sensing signal output by the sensing circuit, and transmit the at least one sensing signal to the controller in response to an output control signal; and the at least one sensing signal includes at least the threshold compensation voltage; or the external compensation circuit further includes the storage circuit, and the storage circuit is connected between the sensing circuit and the controller; the storage circuit is configured to store at least one sensing signal output by the sensing circuit, and transmit the at least one sensing signal to the controller in response to the output control signal; and the at least one sensing signal includes at least the threshold compensation voltage; wherein the storage circuit includes a storage capacitator, an eighth switch and a ninth switch;

the sensing circuit is connected to a first electrode of the storage capacitor through the eighth switch; the controller is connected to the first electrode of the storage capacitor through the ninth switch; and a second electrode of the storage capacitor is grounded.

13. The pixel compensation device according to claim 1, wherein the driving sub-circuit includes a driving transistor; wherein a first electrode of the driving transistor is the first terminal of the driving sub-circuit, and a control electrode of the driving transistor is the control terminal of the driving sub-circuit.

14. A pixel compensation method applied to the pixel compensation device according to claim 1, the pixel compensation method comprising a plurality of light-emitting driving periods, and a light-emitting driving period of the plurality of light-emitting driving periods includes the initialization phase, the pre-storage phase and the data compensation writing phase;

in the initialization phase, the first input circuit transmits the first voltage to the first terminal of the driving sub-circuit, and the second input circuit transmits the second voltage to the control terminal of the driving sub-circuit, so that the driving sub-circuit is turned on;

in the pre-storage phase, the first input circuit performs blanking, and the second input circuit maintains a voltage of the control terminal of the driving sub-circuit at the second voltage, so that a voltage of the first terminal of the driving sub-circuit changes from the first voltage to the threshold compensation voltage;

in the data compensation writing phase, the controller transmits the data voltage to the control terminal of the driving sub-circuit, the sensing circuit senses the threshold compensation voltage and transmits the threshold compensation voltage to the first input circuit, and the first input circuit feeds the threshold compensation voltage back to the first terminal of the driving sub-circuit.

15. The pixel compensation method according to claim 14, wherein the data voltage is a voltage corrected by the controller according to an actual characteristic value of the driving sub-circuit determined in a previous light-emitting driving period.

16. The pixel compensation method according to claim 14, wherein in the initialization phase, the driving sub-circuit is turned on to output a first current, and the sensing circuit senses the first current and transmits the first current to the controller;

in the data compensation writing phase, the sensing circuit transmits the sensed threshold compensation voltage to the controller, the controller determines an actual characteristic value of the driving sub-circuit according to the first current and the threshold compensation voltage and corrects a data voltage to be transmitted in a next data compensation writing phase according to the actual characteristic value.

17. The pixel compensation method according to claim 14, wherein the light-emitting driving period further includes an aging-sensing phase; the pixel compensation method further comprises: in the aging sensing phase, the second input circuit transmitting a third voltage to the control terminal of the driving sub-circuit to control the driving sub-circuit to be turned off; the sensing circuit sensing a second current transmitted from the light-emitting device to the first terminal of the driving sub-circuit; and the controller determining aging information of the light-emitting device according to the second current and correcting a data voltage to be transmitted according to the aging information; or the light-emitting driving period further includes the aging-sensing phase; the pixel compensation method further comprises: in the aging sensing phase, the second input circuit transmitting the third voltage to the control terminal of the driving sub-circuit to control the driving sub-circuit to be turned off; the sensing circuit sensing the second current transmitted form the light-emitting device to the first terminal of the driving sub-circuit; and the controller determining the aging information of the light-emitting device according to the second current and correcting the data voltage to be transmitted according to the aging information; wherein the controller is connected to a plurality of external compensation circuits, and the external compensation circuit is connected to pixel driving circuits;

different sensing circuits in different external compensation circuits or a same external compensation circuit sense the first current for a same duration; and/or, different sensing circuits in different external compensation circuits or a same external compensation circuit sense the second current for a same duration.

18. The pixel compensation method according to claim 14, wherein the sensing circuit includes a voltage sensing sub-circuit;

the light-emitting driving period further includes a first calibration phase;

the pixel compensation method further comprises:

in the first calibration phase, the first input circuit transmitting the first voltage to the voltage sensing sub-circuit, so that the voltage sensing sub-circuit outputs a fourth voltage to the controller; and in the first calibration phase, the controller correcting a sensing voltage signal transmitted from the voltage sensing sub-circuit to the controller according to a difference between the fourth voltage and the first voltage.

19. The pixel compensation method according to claim 14, wherein the sensing circuit includes a current sensing sub-circuit;

the light-emitting driving period further includes a second calibration phase;

the pixel compensation method further comprises:

in the second calibration phase, a reference current source transmitting a reference current to the current sensing sub-circuit, so that the current sensing sub-circuit outputs a third current; and in the second calibration phase, the controller correcting at sensing current signal: transmitted by the current sensing sub-circuit to the controller according to a difference between the third current and the reference current.

20. A display apparatus, comprising the pixel compensation device according to claim 1.

* * * * *